US006570082B2

(12) United States Patent
Mukaino et al.

(10) Patent No.: US 6,570,082 B2
(45) Date of Patent: May 27, 2003

(54) TONE COLOR SELECTION APPARATUS AND METHOD

(75) Inventors: Hirofumi Mukaino, Maisaka (JP); Mikihiro Hiramatsu, Hamakita (JP); Hiroshi Shimizu, Hamamatsu (JP); Atsushi Fukada, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/108,604

(22) Filed: Mar. 28, 2002

(65) Prior Publication Data

US 2002/0139238 A1 Oct. 3, 2002

(30) Foreign Application Priority Data

Mar. 29, 2001 (JP) ..... 2001-094490

(51) Int. Cl.[7] ..... G10H 1/06; G10H 7/00
(52) U.S. Cl. ..... 84/622; 84/645
(58) Field of Search ..... 84/622, 645, 659

(56) References Cited

U.S. PATENT DOCUMENTS 5,345,035 A * 9/1994 Yamada ..... 84/622
5,569,869 A * 10/1996 Sone ..... 84/609
6,103,965 A * 8/2000 Kumagai ..... 84/622
RE36,910 E * 10/2000 Nakata ..... 84/659
6,274,799 B1 * 8/2001 Shimizu ..... 84/622
2002/0046899 A1 * 4/2002 Mizuno et al. ..... 181/142

* cited by examiner

*Primary Examiner*—Jeffrey Donels
(74) *Attorney, Agent, or Firm*—Morrison & Foerster LLP

(57) ABSTRACT

Tone color selecting space is provided, where tone color data are allocated to addressable locations in association with tone color selection information in accordance with a predetermined tone color standard. Into the tone color selecting space can be loaded not only tone color data compliant with the predetermined tone color standard, but also other tone color data, such as those of a standard different from the predetermined tone color standard, loadable externally from an external source. In the tone color selecting space, a dedicated area is set for allocating the externally loaded tone color data. Thus, the externally loaded tone color data can be allocated to the dedicated area and selected in response to tone color selection information designating the dedicated area. If the externally loaded tone color data include specific original tone color selection information, the original tone color selection information may be replaced with the tone color selection information designating the dedicated area such that the tone color data can be selected in response to the original tone color selection information. The externally loaded tone color data may be given priority over the tone color data compliant with the predetermined tone color standard so that the externally loaded tone color data can be allocated to an addressable location in the tone color selecting space with storage location allocation corresponding to the original tone color selection information.

22 Claims, 10 Drawing Sheets

TONE COLOR SELECTING TABLE UNIT A

| |
|---|
| BANK SELECT MSB TABLE |
| BANK SELECT LSB TABLE 1 |
| BANK SELECT LSB TABLE 2 |
| PROGRAM CHANGE PGM TABLE 1 |
| PROGRAM CHANGE PGM TABLE 2 |
| PROGRAM CHANGE PGM TABLE 3 |
| ⋮ |
| PROGRAM CHANGE PGM TABLE X1 |
| PROGRAM CHANGE PGM TABLE X2 |

FIG. 6A

BANK SELECT MSB TABLE

| | |
|---|---|
| 000 | BANK SELECT LSB TABLE 1 |
| 016 | BANK SELECT LSB TABLE 2 |
| 064 | PGM_129 |
| 126 | PGM_130 |
| 127 | PGM_131 |

FIG. 6B

BANK SELECT LSB TABLE 1

| | |
|---|---|
| 000 | PGM_1 |
| 001 | PGM_2 |
| ⋮ | ⋮ |
| 127 | PGM_128 |

FIG. 6C

BANK SELECT LSB TABLE 2

| | |
|---|---|
| 000 | PGM_X1 |
| 001 | PGM_X2 |

FIG. 6D

PROGRAM CHANGE TABLE 1

| | |
|---|---|
| 000 | INST_T1(0) |
| 001 | INST_T1(1) |
| 002 | INST_T1(2) |
| ⋮ | ⋮ |
| 127 | INST_T1(127) |

FIG. 6E

PROGRAM CHANGE TABLE ×1

| | |
|---|---|
| 000 | INST_X1(0) |
| 001 | INST_X1(1) |
| 002 | INST_X1(2) |
| ⋮ | ⋮ |
| 127 | INST_X1(127) |

FIG. 6F

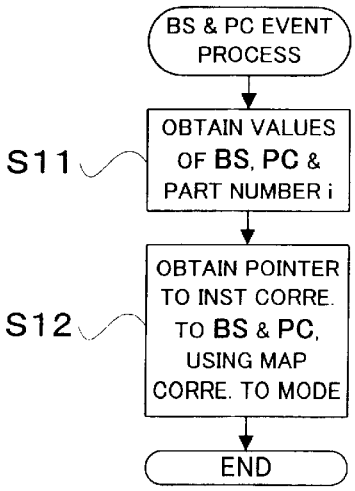

FIG. 10

TONE COLOR SELECTING TABLE UNIT B

| |
|---|
| BANK SELECT MSB TABLE |
| BANK SELECT MSB TABLE Y1 |
| BANK SELECT LSB TABLE 1 |
| BANK SELECT LSB TABLE Y1 |
| ⋮ |
| PROGRAM CHANGE PGM TABLE 1 |
| PROGRAM CHANGE PGM TABLE 2 |
| PROGRAM CHANGE PGM TABLE 3 |
| ⋮ |
| PROGRAM CHANGE PGM TABLE Y1 |
| PROGRAM CHANGE PGM TABLE Y2 |
| ⋮ |

FIG. 8A

BANK SELECT MSB TABLE Y1

| | |
|---|---|
| 000 | BANK SELECT LSB TABLE 1 |
| 024 | BANK SELECT LSB TABLE Y1 |
| 064 | PGM_129 |
| 126 | PGM_130 |
| 127 | PGM_131 |

FIG. 8B

BANK SELECT LSB TABLE Y1

| | |
|---|---|
| 000 | PGM_Y1 |
| 001 | PGM_2 |
| ⋮ | ⋮ |
| 127 | PGM_128 |

FIG. 8C

PROGRAM CHANGE PGM TABLE Y1

| | |
|---|---|
| 000 | INST_T1(0) |
| 001 | INST_T1(1) |
| 002 | INST_Y1(2) |
| ⋮ | ⋮ |
| 127 | INST_T1(127) |

FIG. 8D

TONE COLOR MAP B

| | | |
|---|---|---|
| PGM__1 | MSB000 | LSB000 |
| PGM__Y1 | | LSB001 |
| VACANT | | |
| PGM__5 | | LSB005 |
| ⋮ | | ⋮ |
| PGM__128 | | LSB127 |
| VACANT | MSB001−MSB015 | |
| PGM__Y2 | MSB016 | LSB000 |
| VACANT | MSB017 −MSB023 | |
| ⋮ | | |
| PGM__Y3 | MSB024 | LSB000 |
| VACANT | MSB025 −MSB063 | |
| ⋮ | | |
| PGM__129 | MSB064 | LSB000 |
| VACANT | MSB065 −MSB125 | |
| ⋮ | | |
| PGM__130 | MSB126 | LSB000 |
| PGM__Y4 | MSB127 | LSB005 |

FIG. 9

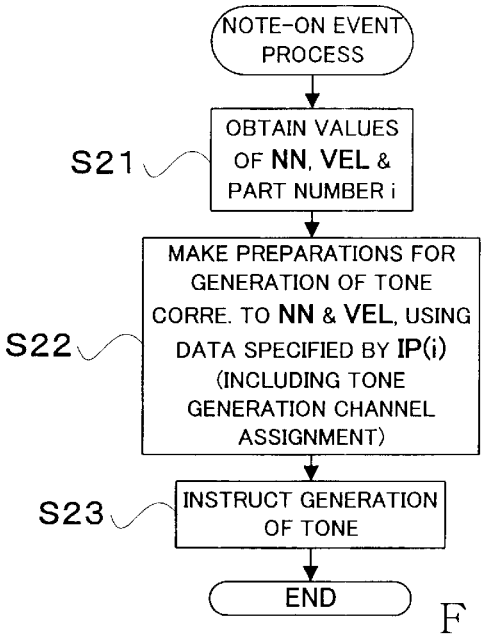
FIG. 12
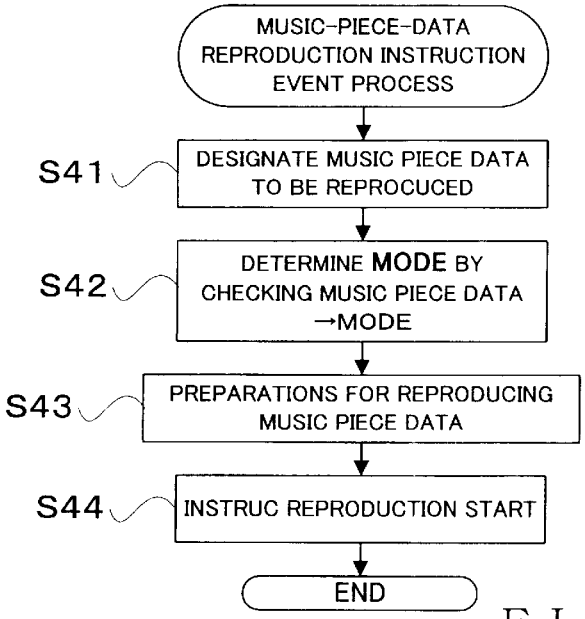
FIG. 13
REPLACING TABLE C1 (OR C2)
| |
|---|
| BS&PC(0) |
| BS&PC(1) |
| BS&PC(2) |
| ⋮ |
| BS&PC(127) |
FIG. 14

TONE COLOR SELECTION APPARATUS AND METHOD

BACKGROUND OF THE INVENTION

The present invention relates to a tone color selection apparatus and method which can take in or load, from any desired external sources, loadable tone color data, such as data of DLS (DownLoadable Sounds) or Sound Font, to thereby add the loaded tone color data to a group of tone color data of a predetermined tone color standard, such as that of the MIDI, in such a manner that the added tone color data can be selected from among the group of tone color data whenever necessary. The present invention also relates to a storage medium to be used for the tone color selection.

MIDI, which is an acronym for Musical Instrument Digital Interface and a registered trademark, is one of the known digital signal interface standards for connecting an electronic musical instrument to another electronic musical instrument or computer. Tone generation apparatus, such as communication karaoke apparatus and DTM (Desk Top Music) apparatus, synthesize waveform data for generation of tones on the basis of music piece data of the standard format prescribed for the MIDI. In such tone generation apparatus, there are prestored, in memory, waveform data necessary for producing tones colors of standard musical instruments such as a piano and guitar. Generally, a tone color is selected in such MIDI tone generators using a program change message. In a case where each program change message is in the form of 7-bit data, only 128 (seventh power of 2) different kinds of tone colors are selectable by program change messages in principle. However, today's sophisticated MIDI tone generators are constructed to permit selection of more than 128 different kinds of tone colors, and they employ the co-called "bank approach" in order to control the selection of more than 128 different kinds of tone colors. In such MIDI tone generators, a given bank is selected from among a plurality of banks, each capable of storing up to 128 kinds of tone colors, in accordance with control change data, and then a given tone color is designated from among the tone colors stored in the selected bank in accordance with a program change number. Typical example of the bank selection scheme uses a combination of bank MSB and LSB. The use of the bank MSB data permits selection of 128 (seventh power of 2) banks and the use of the bank LSB data permits selection of another 128 (seventh power of 2) banks, in which case the selectable tone colors total to the second power of 128.

Tone color selection information for selecting tone color data stored in memory comprises mapping information so as to select a location of desired tone color data in a virtual tone color selecting space called a tone color map. Given tone color selecting space is mapped in accordance with a given tone color standard, so that any tone color selection information (mapping information) compliant with the given tone color standard can accurately select a desired tone color in the given tone color selecting space. Although pieces of tone-related information are unified or standardized today with respect to their fundamental aspects just as in the case of the MIDI standard, details and various extended functions of the tone-related information differ variously among musical instrument makers. Particularly, regarding the tone color selecting space, the musical instrument makers have been building systems on the basis of their own specifications while the specifications are fundamentally based on the data format of the MIDI standard. Accordingly, in some cases, tone color data in a tone color selecting space compliant with a given tone color standard can not be accurately selected with tone color selection information compliant with another standard different from the given tone color standard.

Typically, the MIDI tone generator systems are based on the scheme of prestoring a multiplicity of tone color data (waveform data) in a ROM (Read-Only Memory) and reading out desired ones of the prestored tone color data for desired use. In recent years, some of the MIDI tone generator systems are designed to receive desired tone color data (waveform data) from external sources and store the received tone color data in a writable memory, such as a RAM (Random Access Memory) or hard disk. For example, in the above-mentioned type of tone color selecting space where the selectable banks amount to as many as the "second power of 128", all of the banks are not used for the tone color data prestored in the ROM, so that a considerable number of the banks would remain vacant or unused.

Today, as loadable sound color data sets, there are used the DLS (which is a registered trademark and an acronym for DownLoadable Sounds) and Sound Font (also a registered trademark). However, according to the conventional way of using such loadable tone color sets, a desired tone color set is installed exclusively in a user's electronic musical instrument, and it has never been considered to allocate a separate loadable tone color set to a part of a tone color selecting space storing tone color sets of the MIDI or other standard.

In the case where loadable tone color data, such as DLS, are loaded from an external source and used for tone generation, the conventional tone generation apparatus, in principle, allocate (or map) the loadable tone color data to predetermined addressable locations of a tone color selecting space (i.e., tone color map) compliant with the standard of the loadable tone color data; the predetermined addressable locations are specified by mapping information included in the tone color data to be loaded from the external source. In case other tone color data are already present in the predetermined addressable locations of the tone color selecting space specified by the mapping information of the loadable tone color data, the conventional tone generation apparatus allocate, by way of an exception, the loadable tone color data to other vacant addressable locations of the tone color selecting space. Namely, no particular consideration has heretofore been paid to the standard of the tone color selecting space in the tone generator apparatus receiving the loadable tone color data.

Further, depending on a predetermined tone color standard (e.g., MIDI-GM standard or MIDI-XG standard; these MIDI-based GM standard and XG standard are each a registered trademark) used in the tone color selecting space of a data-receiving tone generator system, even when the tone color selecting space has vacant addressable locations, such vacant addressable locations are sometimes predetermined to be dedicated to allocation thereto of substitute tone color data of a predetermined tone color. Therefore, if tone color data received from an external source is allocated (mapped) to such a dedicated addressable location set aside for the predetermined substitute tone color, and if the externally-received tone color data has no relation to the predetermined substitute tone color, using the externally-received tone color data for tone reproduction would undesirably result in generation of a tone having an inconvenient tone color. In other words, the loadable tone color data would be loaded and allocated to an addressable location deviating from the predetermined tone color standard of the tone color selecting space in the data-receiving tone generator system, with the result that there would be encountered extreme inconveniences when the tone color is reproduced in accordance with tone color selection information compliant with the predetermined tone color standard, e.g. when an automatic performance is executed in accordance with performance data including tone color selection information compliant with the predetermined tone color standard.

If, on the other hand, particular loadable tone color data is loaded and allocated to a vacant addressable location of the tone color selecting space in the data-receiving tone generator system which does not agree with mapping information compliant with the standard of the loadable tone color data, and when the tone color is reproduced in accordance with the tone color selection information compliant with the standard of the loadable tone color data (e.g. when an automatic performance is executed in accordance with performance data including tone color selection information compliant with the standard of the loadable tone color data), there would also be encountered inconveniences.

SUMMARY OF THE INVENTION

In view of the foregoing, it is an object of the present invention to provide a tone color selection apparatus and method which, where tone color data loadable from an external source are allocated to addressable locations in a tone color selecting space compliant with a predetermined tone color standard, allow appropriate tone color selection to be made in accordance with the predetermined tone color standard without causing any inconveniences.

It is another object of the present invention to provide a tone color selection apparatus and method which, where tone color data loadable from an external source are allocated to addressable locations in a tone color selecting space compliant with a predetermined tone color standard, can also permit tone color selection in accordance with original tone color selection information of the externally-loadable tone color data.

According to an aspect of the present invention, there is provided a tone color selection apparatus including a tone color selecting space where tone color data are allocated to addressable locations thereof in association with tone color selection information in accordance with a predetermined tone color standard, to allow desired tone color data to be selected from the tone color selecting space in response to given tone color selection information. The tone color selection apparatus comprises: a memory; a loading device adapted to load tone color data externally loadable from outside the tone color selection apparatus, tone color data externally loaded from outside the tone color selection apparatus via the loading device being stored in the memory; and a processor coupled with the loading device and the memory. In the invention, the processor is adapted to set, in the tone color selecting space compliant with the predetermined tone color standard, a dedicated area for allocation thereto of the externally loaded tone color data, and allocating the externally loaded tone color data, stored in the memory, to the dedicated area in such a manner that the tone color data can be selected in response to tone color selection information designating the dedicated area.

With such inventive arrangements, mapping is performed such that tone color data externally loaded from outside the tone color selection apparatus are allocated to a dedicated area of the tone color selecting space and then selection of the externally loaded tone color data is made in accordance with tone color selection information designating the dedicated area pursuant to a predetermined tone color standard. Thus, the externally loaded tone color data can be selected without disturbing mapping rules compliant with the predetermined tone color standard. For example, even when an area where a substitute tone color compliant with the predetermined tone color standard should be allocated is vacant or empty in the tone color selecting space compliant with the predetermined tone color standard, the externally tone color data can be prevented from being indiscriminately allocated to that vacant area, so that it is possible to avoid any inconvenience in the tone color selection pursuant to the predetermined tone color standard. The allocation, to such a dedicated area, of tone color data loaded externally from outside the tone color selection apparatus will be set forth in the following description of embodiments in relation to "tone color selecting table unit A".

As noted earlier, the tone color selecting space may be a virtual space for mapping tone color data. Locations for actually physically storing the individual tone color data in the invention are desired or appropriately selected storage locations of the memory. In such a case, an appropriate tone color selecting table intervenes between tone color selection information entered for selectively reading out desired tone color data and the tone color data. This arrangement constitutes a general form of memory management in the present invention. Of course, the present invention is not limited to such a form of memory management; for example, the physical memory itself may provide the tone color selecting space, in which case the intervention of the tone color selecting table may be dispensed with.

As an example, the above-mentioned memory also store other tone color data compliant with the predetermined tone color standard and the processor has a tone color selecting table defining correspondency between the tone color selection information and stored locations, in the memory, of the tone color data, so that the tone color selecting table is addressable by the tone color selection information. In this case, the above-mentioned dedicated area is set in the tone color selecting table, and information indicative of the stored location, in the memory, of the externally loaded tone color data is stored in the dedicated area of the memory. The substance of the tone color selecting space, which is a virtual space for mapping tone color data, may be defined by both the tone color selecting table and the memory.

In an embodiment of the present invention, the tone color data externally loadable from outside the tone color selection apparatus includes original tone color selection information indicative of an original allocated addressable location specific thereto. The processor is further adapted to replace the original tone color selection information with tone color selection information designating the dedicated area in accordance with the predetermined tone color standard, and the processor is also adapted to select the tone color data from the dedicated area in accordance with the original tone color selection information. By thus replacing the original tone color selection information with tone color selection information designating the dedicated area, the "externally loaded tone color data" mapped in the tone color selecting space, compliant with the predetermined tone color standard, in accordance with the predetermined tone color standard can be selected using the original tone color selection information specific to the tone color data. For example, in a tone generation apparatus including a tone color selecting space compliant with a predetermined tone color standard, even when an automatic performance is to be executed in accordance with performance data including original tone color selection information of loadable tone color data, the performance can be carried out appropriately, without causing inconveniences, through the replacement of the original tone color selection information and taking advantage of the allocation, to an addressable location of the tone color selecting space, of the original tone color selection information.

In another embodiment, a plurality of tone color data can be allocated to the dedicated area of the tone color selecting space, and the loadable tone color data include original tone color selection information indicative of an original allocated addressable location specific thereto. When the externally loaded tone color data are to be allocated to the dedicated area, the externally loaded tone color data are allocated to a particular location, in the dedicated area, specified by the original tone color selection information if the original tone color selection information of the externally loaded tone color data specifies the dedicated area, but, if the original tone color selection information of the externally loaded tone color data does not specify the dedicated area, the externally loaded tone color data are allocated to another available location in the dedicated area. Thus, when the "externally loaded tone color data" are to be allocated (mapped) to the tone color selecting space compliant with the predetermined tone color standard, and if the original tone color selection information of the "externally loaded tone color data" can be used, the allocation (mapping) of the tone color data can be performed taking the original tone color selection information into consideration as much as possible. In this case too, even when an automatic performance is to be executed, in a tone generation apparatus including a tone color selecting space compliant with a predetermined tone color standard, in accordance with performance data including original tone color selection information of loadable tone color data, the performance can be carried out appropriately, without causing inconveniences, through the replacement of the original tone color selection information and taking advantage of the allocation, to an addressable location of the tone color selecting space, of the original tone color selection information.

According to another aspect of the present invention, there is provided a tone color selection apparatus including a tone color selecting space where tone color data are allocated to addressable locations thereof in association with tone color selection information in accordance with a predetermined tone color standard, to allow desired tone color data to be selected from the tone color selecting space in response to given tone color selection information, which apparatus comprises: a memory; a loading device adapted to load tone color data externally loadable from outside the tone color selection apparatus, the tone color data externally loadable from outside the tone color selection apparatus via the loading device being stored in the memory, the externally loadable tone color data including original tone color selection information indicative of an original allocated addressable location specific thereto; and a processor coupled with the loading device and the memory. The processor is adapted to allocate the externally loaded tone color data, stored in the memory, to a given addressable location in the tone color selecting space such that the externally loaded tone color data can be selected in response to the original tone color selection information of the externally loaded tone color data. In this case, when other tone color data are already allocated to the given addressable location, the processor makes the externally loaded tone color data selectable with priority and makes the other tone color data non-selectable, so that the externally loaded tone color data can be selected in response to the original tone color selection information.

In this invention, when the "externally loaded tone color data" are to be allocated (mapped) to the tone color selecting space compliant with the predetermined tone color standard, the externally loaded tone color data are allocated, with priority over other data, to a given addressable location, of the tone color selecting space, according to the original tone color selection information of the externally loaded tone color data. When other tone color data are already allocated to the given addressable location of the tone color selecting space, and even if the other tone color data are compliant with the predetermined tone color standard, the processor makes the other tone color data non-selectable, and allocates (maps) the externally loaded tone color data in accordance with the original tone color selection information. Thus, even when an automatic performance is to be executed, in a tone generation apparatus including a tone color selecting space compliant with a predetermined tone color standard, in accordance with performance data including original tone color selection information of loadable tone color data, the performance can be carried out appropriately taking advantage of the allocation, to an addressable location of the tone color selecting space, of the original tone color selection information. Such a feature of allocating the externally loaded tone color data to an addressable location of the tone color selecting space in accordance with the original tone color selection information is set forth in the following description of embodiments in relation to "tone color selecting table unit B".

As an example, the memory also stores other tone color data compliant with the predetermined tone color standard, the processor has a tone color selecting table defining correspondency between the tone color selection information and stored locations, in the memory, of the tone color data, and the tone color selecting table is addressable by the tone color selection information. In this case, information indicative of the stored location, in the memory, of the externally loaded tone color data is stored in an area of the tone color selecting table addressable by the original tone color selection information.

In an embodiment, the tone color selection apparatus further comprises an operator operable to cancel the externally loaded tone color data allocated to a particular addressable location in the tone color selecting space. When, the externally loaded tone color data are canceled by canceling operation via the operator, the processor resets the particular addressable location in the tone color selecting space, where the externally loaded tone color data have been stored so far, to an initial addressable location compliant with the predetermined tone color standard. Thus, even in the case where the externally loaded tone color data were allocated, with priority, to the particular addressable location, of the tone color selecting space, according to the original tone color selection information, the particular addressable location can be reset to the initial addressable location compliant with the predetermined tone color standard after the externally loaded tone color data are canceled via the canceling operator, with the result that tone color selection can be made without causing any inconveniences.

According to still another aspect of the present invention, there is provided a tone color selection apparatus including a tone color selecting space where tone color data are allocated to addressable locations thereof in association with tone color selection information in accordance with a predetermined tone color standard, to allow desired tone color data to be selected from the tone color selecting space in response to given tone color selection information, which comprises: a memory; a loading device adapted to load tone color data externally loadable from outside the tone color selection apparatus, tone color data externally loaded from outside the tone color selection apparatus via the loading device being stored in the memory; a processor coupled with the loading device and the memory and adapted to set, in the tone color selecting space compliant with the predetermined tone color standard, a dedicated area for allocation thereto of tone color data externally loadable from outside the tone color selection apparatus, and allocate the externally loaded tone color data, stored in the memory, to the dedicated area in such a manner that the externally loaded tone color data can be selected in response to tone color selection information designating the dedicated area. The processor is also adapted to: execute a first process for making the externally loaded tone color data selectable in response to the tone color selection information designating the dedicated area; and execute a second process for replacing original tone color selection information specific to the externally loaded tone color data with the tone color selection information designating the dedicated area where the externally loaded tone color data are allocated, and for making the externally loaded tone color data selectable in response to the replaced tone color selection information so that the externally loaded tone color data can be selected with the addressable location specified by the original tone color selection information. The tone color selection apparatus further comprises a mode selector coupled with the processor and adapted to select one of a first mode for causing the processor to select the tone color data through the first process and a second mode for causing the processor to select the tone color data through the second process.

Thus, in a tone generation apparatus including a tone color selecting space compliant with a predetermined tone color standard, when an automatic performance is to be executed, for example, in accordance with performance data including tone color selection information compliant with a predetermined tone color standard, the first mode using the first process is selected, while when an automatic performance is to be executed in accordance with performance data including original tone color selection information of loadable tone color data, the second mode using the second process is selected. By thus properly using the mode selection, it is possible to execute, without causing inconveniences, not only the performance based on the tone color selection information compliant with the predetermined tone color standard but also the performance based on the original tone color selection information of loadable tone color data.

According to still another aspect of the present invention, there is provided atone color selection apparatus including a tone color selecting space where tone color data are allocated to addressable locations thereof in association with tone color selection information in accordance with a predetermined tone color standard, to allow desired tone color data to be selected from the tone color selecting space in response to given tone color selection information, which apparatus comprises: a memory; a loading device adapted to load tone color data externally loadable from outside the tone color selection apparatus, tone color data externally loaded from outside the tone color selection apparatus via the loading device being stored in the memory; a processor coupled with the loading device and the memory and adapted to: execute a first process for setting, in the tone color selecting space compliant with the predetermined tone color standard, a dedicated area for allocation thereto of tone color data externally loadable from outside the tone color selection apparatus, allocating the externally loaded tone color data, stored in the memory, to the dedicated area in such a manner that the externally loaded tone color data can be selected in response to tone color selection information designating the dedicated area, and making the externally loaded tone color data selectable in response to the tone color selection information designating the dedicated area; and execute a second process for allocating the externally loaded tone color data, stored in the memory, to a given addressable location in the tone color selecting space such that the externally loaded tone color data can be selected in response to original tone color selection information specific to the externally loaded tone color data, and for, when other tone color data are already allocated to the given addressable location, making the externally loaded tone color data selectable with priority and making the other tone color data non-selectable, to thereby allow the externally loaded tone color data to be selected in response to the original tone color selection information; and a mode selector coupled with the processor and adapted to select one of a first mode for causing the processor to select the tone color data through the first process and a second mode for causing the processor to select the tone color data through the second process.

In the following description of the embodiments, a process corresponding to the above-mentioned first process will be explained in relation to "tone color selecting table unit A", while a process corresponding to the above-mentioned second process will be explained in relation to "tone color selecting table unit B". In this case too, by properly using the mode selection in a tone generation apparatus including a tone color selecting space compliant with a predetermined tone color standard, it is possible to execute, without causing inconveniences, not only the performance based on the tone color selection information compliant with the predetermined tone color standard but also the performance making use of the original tone color selection information of loadable tone color data.

In an embodiment, the mode selector makes a determines, in accordance with information indicative of a tone color standard included in performance data, whether tone color data compliant with the predetermined tone color standard should be used or the externally loaded tone color data should be used, and automatically selects one of the first mode and the second mode on the basis of a result of the determination. By automatically using the mode selection properly in accordance with a standard of automatic performance data of a music piece in a tone generation apparatus including a tone color selecting space compliant with a predetermined tone color standard, it is possible to execute the performance without causing inconveniences.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the objects and other features of the present invention, its embodiments will be described in greater detail hereinbelow with reference to the accompanying drawings, in which:

FIG. 6A is a conceptual diagram explanatory of a general organization of tone color selecting table unit A, and FIGS. 6B to 6F are conceptual diagrams explanatory of contents of individual tables in tone color selecting table unit A of FIG. 6A;

FIG. 8A is a conceptual diagram explanatory of a general organization of tone color selecting table unit B, and FIGS. 8B to 8D are conceptual diagrams explanatory of contents of individual tables in tone color selecting table unit B of FIG. 8A;

FIG. 9 is a conceptual diagram showing a specific example of tone color map B based on tone color selecting table unit B;

FIG. 10 is a flow chart showing an example of a BS/PC event process carried out in the embodiment;

FIG. 12 is a flow chart showing an example of a note-on event process carried out in the embodiment;

FIG. 13 is a flow chart showing an example of a music-piece-data reproduction instruction event process carried out in the embodiment;

FIG. 14 is a conceptual diagram showing an example of replacing tables;

DETAILED DESCRIPTION OF EMBODIMENTS

Figure 1:
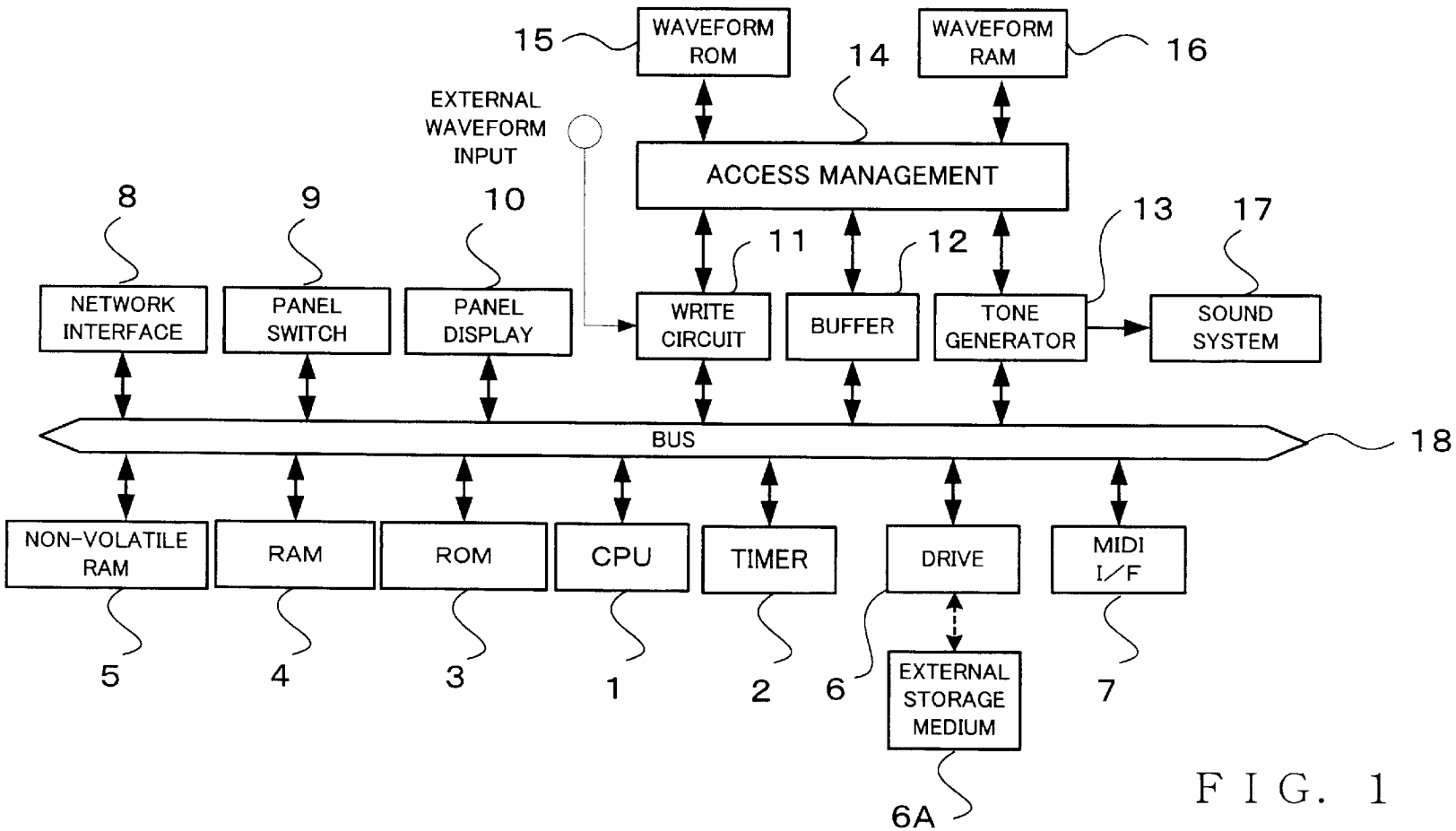
FIG. 1 is a block diagram illustrating an exemplary general hardware setup of an electronic musical instrument to which is applied a tone color selection apparatus of the present invention.

FIG. 1 is a block diagram illustrating an exemplary general hardware setup of an electronic musical instrument to which is applied a tone color selection apparatus and method of the present invention. This electronic musical instrument is controlled by a microcomputer comprising a microprocessor unit (CPU) 1, a read-only memory (ROM) 3 and volatile and nonvolatile random-access memories (RAMs) 4 and 5. The CPU 1 controls all operations of the electronic musical instrument. To the CPU 1 are connected, via a data and address bus 18, the read-only memory (ROM) 3, volatile and nonvolatile random-access memories (RAMs) 4 and 5, storage medium drive 6, MIDI interface (I/F) 7, network interface 8, panel operator unit 9, panel display circuit 10, write circuit 11, buffer 12, and tone generator 13. Also connected to the CPU 1 is a timer 2 for counting various time periods, for example, to signal interrupt timing for a timer interrupt process. Namely, the timer 2 generates tempo clock pulses for counting a time interval or setting a reproduction tempo with which to reproduce a generated tone. The frequency of the tempo clock pulses is adjustable via a tempo setting switch and the like on the panel operator unit 9. Such tempo clock pulses generated by the timer 2 are given to the CPU 1 as processing timing instructions or as interrupt instructions. The CPU 1 carries out various processes in accordance with such instructions. The various processes carried out by the CPU 1 in the instant embodiment include a screen display process for displaying stored tone color names etc.

It should be appreciated that the electronic musical instrument embodying the present invention may be other than a dedicated musical instrument, such as a general-purpose apparatus like a personal computer, or apparatus or equipment having a tone generating function like multimedia equipment. In short, the electronic musical instrument embodying the present invention may be an apparatus or equipment constructed to download tone color data (i.e. waveform data and the like) externally from outside the tone color selection apparatus, store the downloaded tone color data and then selectively read out desired ones of the stored tone color data, using predetermined software or hardware configured in accordance with the principles of the present invention.

The ROM 3 has prestored therein various programs to be executed by the CPU 1, various data to be referred to by the CPU 1, preset data of tone colors compliant with a predetermined tone color standard, e.g. MIDI-GM standard (trademark) or MIDI-XG standard (trademark), bank selection data called "bank select MSB" and "bank select LSB", tone selecting table from which to select a tone color designated by a program change number, etc. The RAM 4 is used as a memory for storing preset data related to externally loaded tones, tone color selecting table from which to select a desired one of externally loaded tone colors. The RAM 4 is also used as a working memory for temporarily storing a currently-executed program and various data and the like generated as the CPU 1 executes a predetermined program. Predetermined address regions of the RAM 4 are allocated and used as registers, flags, tables, memories, etc. INFO chunk data and PRESET DATA chunk data of a tone color file in the DLS or Sound Font format which is used to add tone color data (i.e., waveform data and the like) are stored in the RAM 4. The nonvolatile RAM 5 is a memory for temporarily storing a control program executed by the CPU 1 and the like.

The storage medium drive 6 drives an external storage medium 6A having stored therein various data, such as tone color files used to add tone color data and waveform data, control programs for execution by the CPU 1 and the like, so that desired data, control program or the like can be loaded into the electronic musical instrument by the drive 6 driving the external storage medium 6A. For example, by the activation of the storage medium drive 6, INFO chunk data or PRESET DATA chunk data of a tone color file stored in the external storage medium 6A are read out from the medium 6A into the RAM 4 for storage therein. In a case where a particular control program is not prestored in the ROM 3, the particular control program may be prestored in the external storage medium 6A, so that, by reading the particular control program from the external storage medium 6A into the RAM 4 (or into the nonvolatile RAM 5), the CPU 1 is allowed to operate in exactly the same way as in the case where the particular control program is stored in the program memory 3. This arrangement greatly facilitates version upgrade of a control program, addition of a new control program, etc. The external storage medium 6A may be any desired fixed (non-removable) storage medium such as a hard disk (HD), or any of desired removal storage media such as a floppy disk (FD), compact disk (CD-ROM or CD-RAM), magneto-optical disk (MO), digital versatile disk (DVD) and semiconductor memory like a RAM card.

The MIDI interface (I/F) 7 is provided for receiving or delivering tone information of the MIDI standard (MIDI data) from or to other MIDI equipment (not shown) or the like external to the electronic musical instrument. Note that the other MIDI equipment may be of any type, such as a keyboard type, guitar type, wind instrument type, percussion instrument type or gesture type, as long as it can generate MIDI data in response to manipulations by a user or player. The MIDI interface 7 may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface 7, the other MIDI equipment may be designed to communicate (transmit or receive) other data than MIDI event data. Of course, the musical information handled in the present invention may be of any other data format than the MIDI format, in which case the MIDI interface 7 and other MIDI equipment are constructed in conformity to the data format used. In such a case, any desired tone color file in the DLS or Sound Font format can be transferred to the RAM 4 of the electronic musical instrument via the MIDI interface 7 rather than the external storage medium 6A.

Further, the network interface 8 is a bidirectional input/output interface which is connected to a wired or wireless communication network (not shown), such as a LAN (Local Area Network), the Internet, optical cable, telephone line network or ISDN (Integrated Service Digital Network), via which it can be connected to a desired sever computer (not shown) so as to input a control program and various data (including tone color data loadable externally from outside the electronic musical instrument, i.e. from an external source) to the electronic musical instrument. Thus, in a case where a particular control program and various data are not contained in the ROM 3, RAM 4 or the like, these control program and data can be downloaded from a desired server computer via the network interface 8. In such a case, the electronic musical instrument, which is a "client", sends a command to request the server computer to download the control program and various data by way of the network interface 8 and communication network. In response to the command from the client, the server computer delivers the requested control program and data to the electronic musical instrument via the communication network. The electronic musical instrument receives the control program and data via the network interface 8 and accumulatively store them into the RAM 4 or the like. In this way, the necessary downloading of the control program and various data is completed. For example, any desired tone color file in the DLS or Sound Font format is delivered from a server computer on the communication network via the network interface 8 to the electronic musical instrument and stored in the RAM 4, non-volatile RAM 5, hard disk or the like of the electronic musical instrument.

The panel operator unit 9 includes various switches and operators for designating various parameters, inputting various musical performance conditions to be used for reproducing music piece data. For example, the panel operator unit 9 may include various other operators, such as a ten-button keypad for entry of numeric value data, a keyboard for entry of text data, for selecting, setting and controlling a tone pitch, color, effect, etc. Switch information, corresponding to detected operational states of the operators, is supplied to the CPU 1 via the data and address bus ID. The panel display circuit 10 visually displays not only the switches of the panel operator unit 9 but also various performance conditions to be used for reproduction of music piece data and controlling states of the CPU 1, on a display that may comprise an LCD (Liquid Crystal Display) or CRT (Cathode Ray Tube).

Waveform ROM 15 is a waveform memory in which are prestored waveform data of tone color files compliant with a predetermined tone color standard, such as the MIDI-GM or MIDI-XG standard, used in the electronic musical instrument in question. Waveform RAM 16 is a waveform memory for storing waveform data of a tone color file loaded from an external source into the electronic musical instrument. When a tone color file compliant with a tone color standard specific to the loadable tone color, such as the DLS or Sound Font standard, has been received, the waveform data of the received loadable tone color file are written into the waveform RAM 16. In accordance with instructions given from the CPU 1, the write circuit 11 samples a waveform received via an external waveform input terminal and then writes the sampled waveform data into the waveform RAM 16 via an access management section 14. The buffer 12 is an access buffer to be used by the CPU 1 to write and read to and from the waveform RAM 16 or read the waveform ROM 15 via the access management section 14. For example, when a desired tone color file is to be loaded into the electronic musical instrument, the CPU 1 writes the waveform data of the tone color file into the waveform RAM 16. The access management section 14 performs management to avoid overlap among access from the above-mentioned write circuit 11, buffer circuit 12 and tone generator 13 to the waveform ROM 15 and waveform RAM 16. Of course, a hard disk is used in place of the waveform RAM 16 to store the waveform data of the received or externally-loaded loadable tone color file.

The tone generator 13, which is capable of simultaneously generating tone signals in a plurality of channels, reads out the waveform data from the waveform ROM 15 or waveform RAM 16 via the access management section 14 and thereby generates tone signals on the basis of the read-out waveform data. Each of the tone signals thus generated by the tone generator 13 is audibly reproduced or sounded by a sound system 17. Any desired tone signal generation method may be used in the tone generator 13, such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Other than the above-mentioned, the tone generator may use the physical model method, harmonics synthesis method, formant synthesis method, analog synthesizer method using a combination of VCO, VCF and VCA, or analog simulation method. Further, the tone generator 13 may be implemented by a combined use of a DSP and microprograms or of a CPU and software programs, rather than by use of dedicated hardware. The tone generation channels to simultaneously generate a plurality of tone signals in the tone generator 13 may be implemented either by using a single circuit on a time-divisional basis or by providing a separate circuit for each of the channels.

Figure 2:
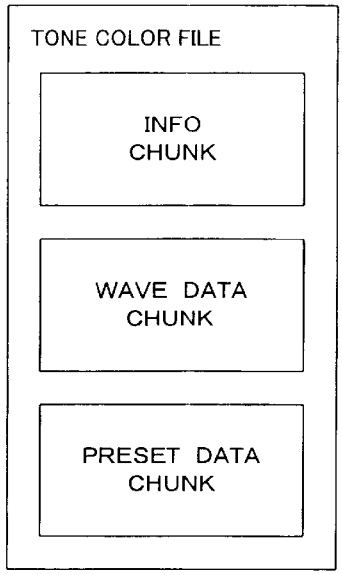
FIG. 2 is a conceptual diagram showing an exemplary general organization of a tone color file compliant with a given tone color standard.
Figure 3:
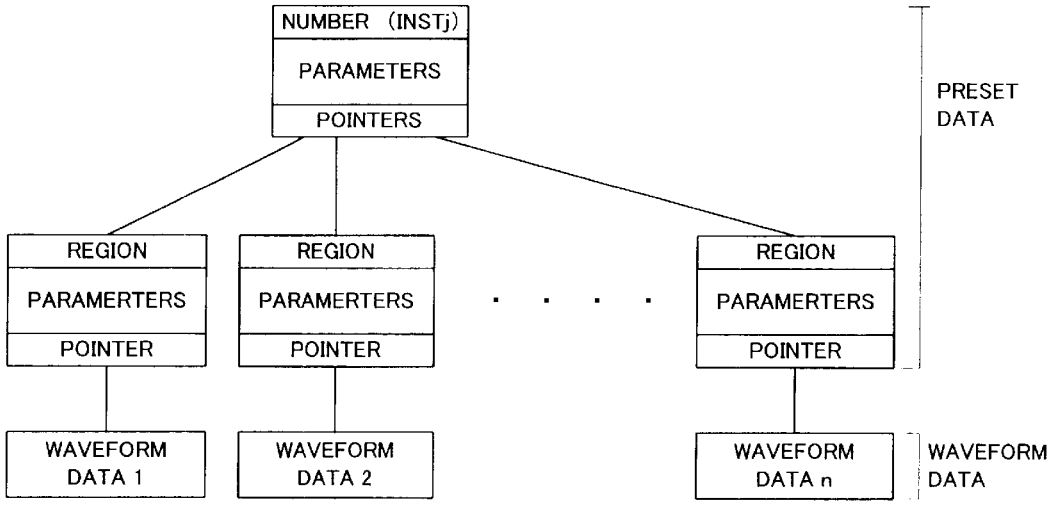
FIG. 3 is a conceptual diagram showing exemplary formats of waveform data and preset data specified by a tone color number, i.e. tone color selection information included in the tone color file.

The following paragraphs briefly describe an example organization of a tone color file, with reference to FIGS. 2 and 3. FIG. 2 is a conceptual diagram showing an exemplary general organization of a tone color file compliant with a given tone color standard, and FIG. 3 is a conceptual diagram showing exemplary formats of waveform data and preset data specified by a tone color number (INSTj) included in the tone color file. For example, the "given tone color standard" here is the predetermined tone color standard, such as the MIDI-GM, MIDI-XG standard or the like, used in the electronic musical instrument provided with the tone color selection apparatus. On the other hand, the standard of tone color files loadable from an external source into the tone generator of the electronic musical instrument is, for example, the DLS or Sound Font standard. In the case of the DLS standard, the general organization of FIG. 2 is that of a tone color file of the DLS standard. For convenience of description, FIGS. 2 and 3 will be described below as showing a tone color file of the DLS standard.

As illustrated in FIG. 2, the tone color file of the DLS standard generally comprises data groups of three chunks: an INFO chunk; a WAVE DATA chunk; and PRESET DATA chunk. The INFO chunk is a group of information/data indicative of a user's name, maker's name and those person who were involved in creation of the tone color data as well as names imparted to the tone colors. The WAVE DATA chunk is a group of specific waveform data forming a basis of tone waveforms to be ultimately reproduced. The WAVE DATA chunk also includes, in addition to the specific waveform data, various related information and data, such as start address data indicative of specific stored locations of the waveform data, loop start/end address data, data indicative of original pitches of the waveform data, etc. The PRESET DATA chunk is a group of information/data including tone color selection information for selecting individual tone colors of the tone color file which are to be allocated (mapped) to addressable locations in a tone color selecting space in accordance with the given tone color standard of the tone color file, various parameters to be used for producing tone waveforms of the individual tone colors, and data for selecting waveform data stored in the WAVE DATA chunk.

FIG. 3 shows, for one tone color (INST: abbreviation for an instrument's tone color name) specified by one tone color number, a relationship between preset data (data of the PRESET DATA chunk) and waveform data (data of the WAVE DATA chunk) selected by the preset data. The preset data are arranged in a hierarchical structure that comprises a single set of common data at a higher hierarchical level and a plurality of sets of region data at a lower hierarchical level. The common data set at the higher hierarchical level comprises a single tone color number, various tone color setting/controlling parameters, and a plurality of region pointers pointing to respective stored locations of the regions at the lower hierarchical level. The tone color number is tone color selection information (i.e., original tone color selection information) for selecting the tone color to be allocated (mapped) to an addressable location of a tone color selecting space compliant with the given tone color standard (e.g., DLS standard) of the tone color file in question. In the instant embodiment, the tone color number is in the form of three-byte data indicating a bank select MSB, bank select LSB and program change number. Namely, in the instant embodiment, each tone color name (INST) is selected by a combination of the bank select MSB, bank select LSB and program change number.

The regions define waveform data groups slightly or appropriately differing in specific contents of the waveform data while the regions pertain to the same tone color name (INST). Namely, as well known, the use of the regions, even though they belong to the same tone color name, is intended to enhance the quality of a generated tone by appropriately differentiating a waveform to be used depending on a pitch range or velocity value range. That is, the regions classify such waveform data groups corresponding to different pitch ranges or velocity value ranges. For example, one of the regions is specified in accordance with a note name, pitch information and/or velocity value of a tone to be generated and the region pointer pointing to the specified region, so that the preset data of the lower hierarchical level corresponding to the region pointer and hence the specified region are read out. The preset data each of the lower-level regions include various tone color setting/controlling parameters, and a waveform pointer pointing to the stored location of the waveform data set (any one of waveform data sets 1, 2, . . . n in FIG. 3) corresponding to the region.

Note that the parameters contained in the preset data of the higher hierarchical level are common parameters for controlling the various waveforms of the tone color name (INST) in question. For example, the parameters include those of tone color envelope characteristics and tone volume envelope characteristics which are known as ADSR (Attack, Decay, Sustain and Release) parameters. The parameters contained in the preset data of the lower hierarchical level are intended to control a waveform separately for each of the regions, and these parameters may be either of different kinds and/or contents from those of the preset data of the higher hierarchical level or of the same different kinds and/or contents as the preset data of the higher hierarchical level. In this way, the parameters can be set to perform the same tone color waveform control on all the waveforms related to the tone color in question, or can be set to perform a different tone color waveform control on each of the regions.

Namely, the tone color file has the above-described data structure such that one tone color (e.g., desired loadable tone color) can be selected therefrom by a combination of the bank select MSB and LSB and program change number and the waveform data of one of the regions belonging to the selected tone color can be specified in accordance with a MIDI note number and velocity.

Irrespective of the format specifications of the tone color file, the file has the fundamental structure as having been described above in relation to FIGS. 2 and 3. Here, the three-byte tone color number, i.e. original tone color selection information, can be set as desired independently of any tone color standard. Accordingly, in electronic musical instruments having the tone color selecting space compliant with the predetermined tone color standard (e.g., MIDI-GM or MIDI-XG standard), where a loadable tone color of the DLS standard or Sound Font standard is loaded for use by their tone generator, the management according to the principles of the present invention will become important. The following description will be made in relation to a case where a loadable tone color of the DLS standard is loaded into the tone color selecting space of the MIDI-XG standard originally provided in the electronic musical instrument.

In response to a download instruction from a user, the electronic musical instrument of FIG. 1 receives a desired "loadable tone color" file (DLS standard) from external equipment via the MIDI interface 7 or network interface 8 or from the external storage medium 6A, such as a CD-ROM, via the storage medium drive 6, and stores the received tone color file in the non-volatile RAM 5, hard disk (HD) or the like. Then, in response to an instruction for loading the stored tone color file, the information/data of the INFO chunk and preset data of the PRESET DATA chunk in the tone color file are additionally registered in the RAM 4, and the waveform data of the WAVE data chunk in the tone color file are additionally registered in the waveform RAM 16. Further, a tone-color-selecting-space allocation/reorganization process is carried out in the embodiment for allocating the "loadable tone color" file (DLS standard) to addressable locations in the tone color selecting space of the MIDI-XG standard originally provided in the electronic musical instrument so that one or more tone colors contained in the file can be used by the electronic musical instrument. Namely, the tone-color-selecting-space allocation/reorganization process allows the one or more new tone colors, i.e. the newly added one or more loadable tone colors, to be used for reproduction of music piece data. Tone color loading process flow charted in FIG. 4 is carried out for loading any desired "loadable tone color" file into the tone generator for use by the electronic musical instrument.

In the illustrated example, the tone-color-selecting-space allocation/reorganization process is carried out using either one of "tone color selecting table unit A" and "tone color selecting table unit B". Generally, in a mode using "tone color selecting table unit A", each "loadable tone color" is allocated in association with a dedicated area of the tone color selecting space and its original tone color selection information is not exploited in this case. In this way, any desired "loadable tone color" can be loaded for subsequent use while reliably maintaining allocation order or rules in the tone color selecting space of the predetermined tone color standard such as the MIDI-XG standard. In a mode using "tone color selecting table unit B", on the other hand, each "loadable tone color" can be allocated to the tone color selecting space of the predetermined tone color standard, such as the MIDI-XG standard, by exploiting its original tone color selection information. Thus, in the electronic musical instrument having the tone color selecting space of the predetermined tone color standard such as the MIDI-XG standard, it is possible to readily execute a tone performance using performance data based on the original tone color selection information of "loadable tone colors". For example, in a situation where any of tone colors of a predetermined tone color standard has unsatisfactory quality, the unsatisfactory tone color can be replaced with tone color data of the loadable tone color having better quality and prepared for the same kind as the tone color of the predetermined tone color standard. In the instant embodiment, there are provided both "tone color selecting table unit A" and "tone color selecting table unit B" so that either one of the two modes can be selected as necessary. However, only one of these tables may of course be provided so that the electronic musical instrument can operate in only one mode. As will be later described, a similar process can be carried out using "tone color selecting table unit A" and "replacing tables" without providing "tone color selecting table unit B".

Figure 4:
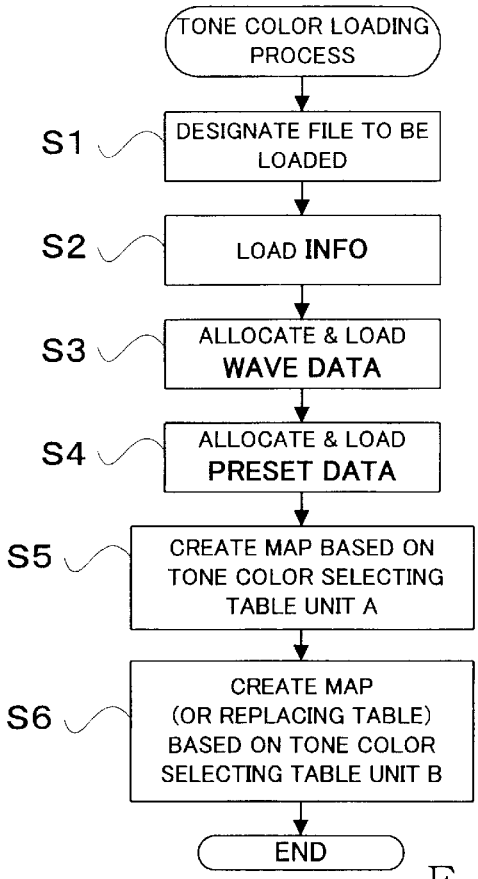
FIG. 4 is a flow chart showing an exemplary step sequence of a tone color loading process carried out in the embodiment.

At step S1 in the tone color loading process of FIG. 4, the user designates, from among tone color files of "loadable tone colors" currently stored in the external storage medium 6 or the like, a desired tone color file that is to be loaded into the tone generator. For example, once the user designates a desired tone color file as by manipulating the panel operator unit 9, the designated tone color file is read out by the drive 6 from the external storage medium 6A, and individual data of the individual chunks are stored in a storage device. At step S2, the information/data in the INFO chunk of the thus-acquired tone color file are stored in the RAM 4. If the prestored information/data of the predetermined tone color standard (e.g., MIDI-XG standard) and the information/data of the loaded "loadable tone color" are displayed together on the panel display 10, the user can readily select a desired tone color from an expanded range of selectable tone colors. At next step S3, the waveform data in the WAVE DATA chunk of the loaded "loadable tone color" file are stored in the waveform RAM 16. At following step S4, the preset data of the PRESET DATA chunk of the loaded tone color file are stored in the RAM 4.

Figure 5A:
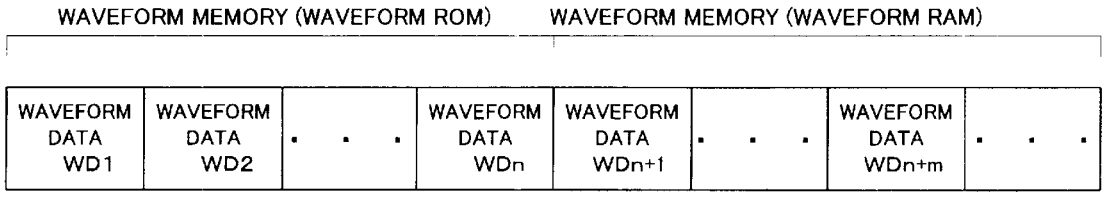
FIGS. 5A and 5B are diagrams showing a memory map of waveform data in a waveform memory and a memory map of preset data in the waveform memory.
Figure 5B:
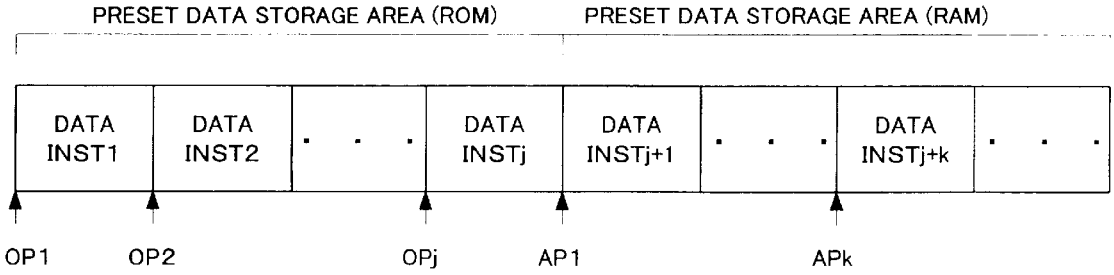

FIGS. 5A and 5B are diagrams showing memory maps of waveform data and preset data of tone colors that are used in the electronic musical instrument and compliant with the predetermined tone color standard (e.g., MIDI-XG standard) and waveform data and preset data of tone colors included in externally loaded "loadable tone colors". Specifically, FIG. 5A conceptually shows memory maps of the waveform-data storing waveform memories (i.e., the waveform ROM 15 and waveform RAM 16), while FIG. 5B conceptually shows a memory map of the preset-data storing memories (i.e., the ROM 3 and RAM 4).

As illustratively shown in FIG. 5A, the waveform ROM 15 has stored therein a plurality of sets of waveform data WD1, WD2, . . . , WDn of tone colors compliant with the predetermined tone color standard (e.g., MIDI-XG standard) (hereinafter called "standard tone colors"). Waveform data sets WDn+1, WDn+2, . . . , WDn+m of "loadable tone colors" are stored in the waveform RAM 16. Further, as illustrated in FIG. 5B, preset data INST1, INST2, . . . , INSTj of a plurality of the "standard tone colors" are prestored in a preset data storage area of the ROM 3. Preset data sets INSTj+1, . . . , INSTj+k of the "loadable tone colors" are prestored in a preset data storage area of the RAM 4. The preset data set of each of the tone colors stored in the preset data storage areas of the ROM 3 and RAM 4 is specified by a preset data pointer pointing to a stored location, in the ROM 3 or RAM 4, of the preset data; note that the pointers pointing to predetermined stored locations of the preset data storage areas of the ROM 3 are denoted by OP1, OP2, . . . , OPj, while the pointers pointing to predetermined stored locations of the preset data storage areas of the RAM 4 are denoted by AP1, AP2, . . . , APj. In the tone color selecting space, there are stored the preset data pointers in association with the tone color selection information, i.e. tone color numbers, of the individual tone colors, so that, for selection of a desired tone color, the corresponding preset data pointer is read out in accordance with the tone color selection information, i.e. tone color number, of the desired tone color. Then, the preset data pointed to by the read-out preset data pointer are read out, and the waveform data are read out in accordance with a waveform data pointer included in the read-out preset data.

Although FIGS. 5A and 5B show the memory maps with the plurality of waveform data sets and preset data sets as being stored in predetermined sequential order, it is in effect not necessary to store these data sets in the memories in such predetermined sequential order. That is, these real data may be stored in dispersed storage locations as appropriate, because these dispersed data can be managed in a systematic fashion in accordance with a known memory management scheme.

Referring back to FIG. 4, at step S5, "tone color selecting table unit A" is created, on the basis of which a tone color map is reorganized in a tone color selection format compliant with the predetermined tone color standard (e.g., MIDI-XG standard) employed in the electronic musical instrument. The "tone color selecting table" defines a tone color selecting space for selecting desired tone color data (preset data and waveform data) in accordance with the above-mentioned tone color selection information. Basically, "tone color selecting table unit A" defines a tone color selecting space where tone color data are stored in association with the tone color selection information in accordance with the predetermined tone color standard (e.g., MIDI-XG standard), and sets a dedicated area in the selecting space for allocating (mapping) tone color data of tone colors loadable from an external source (from outside the electronic musical instrument). Namely, the tone color selection information is allocated in such a manner that the dedicated area is designated for the "loadable tone colors". Basically, in "tone color selecting table unit A", the original tone color selection information of the "loadable tone colors" is ignored, while the tone color selection information is allocated such that the dedicated area is designated for the "loadable tone colors". The dedicated area is an area that is neither used with the tone color format compliant with the predetermined tone color standard (e.g., MIDI-XG standard), nor used as an area for substitute tone colors. Therefore, using such "tone color selecting table unit A", any desired "loadable tone color" can be allocated for subsequent use while reliably maintaining the allocation order or rules in the tone color selecting space of the predetermined tone color standard such as the MIDI-XG standard.

At next step S6, "tone color selecting table unit B" (or replacing table) is created, and a tone color map is reorganized, on the basis of the thus-created table, in the tone color selection format compliant with the predetermined tone color standard (e.g., MIDI-XG standard) employed in the electronic musical instrument, in a similar manner to the above-mentioned. However, with this "tone color selecting table unit B", "loadable tone colors" are allocated to addressable locations in the tone color selecting space in accordance with their original tone color selection information. Namely, the tone color data (preset data and waveform data) of any "loadable tone color" to be loaded into the tone generator of the electronic musical instrument is allocated (mapped) to an addressable location of the tone color selecting space in such a manner that it can be read out in accordance with the original tone color selection information appended thereto. Although, in such a case, other tone color data compliant with the predetermined tone color standard (e.g., MIDI-XG standard) might already exit in (have been allocated to) the locations corresponding to the original tone color selection information of the "loadable tone color", the instant process ignores the other tone color data compliant with the predetermined tone color standard and makes the "loadable tone color" selectable with priority. Thus, basically, in this "tone color selecting table unit B, the original tone color selection information of the "loadable tone color" is given a higher priority. For example, even where an automatic performance is executed, in a tone generation apparatus having a tone color selecting space compliant with a predetermined tone color standard, in accordance with performance data including tone color selection information corresponding to the tone color allocation represented by the original tone color selection information of loadable tone color data, the automatic performance can be executed appropriately utilizing the original tone color allocation. As will be described later, a similar process can be carried out using "tone color selecting table unit A" and "replacing tables" without creating such "tone color selecting table unit B".

This and following paragraphs first detail tone color selecting table unit A. FIGS. 6A to 6F are conceptual diagrams explanatory of the contents of tone color selecting table unit A. Specifically, FIG. 6A is a conceptual diagram explanatory of a general organization of tone color selecting table unit A created in the above-described tone color loading process (see step S5 of FIG. 4). FIGS. 6B to 6F are conceptual diagrams explanatory of individual table contents in tone color selecting table unit A. Note that FIGS. 6A to 6F show virtual tone color selecting table unit A that comprises combinations of tone color selecting tables prestored in the ROM 3 (denoted by non-hatched blocks) and tone color selecting tables to be newly added to the RAM 4 (denoted by hatched blocks). It should also be appreciated that the prestored tone color selecting tables may be provided in the RAM 4 rather than in the ROM 3; in this case, the prestored tone color selecting tables thus provided in the RAM 4 are set in a non-rewritable state.

Here, the tone color selecting format employed in the instant embodiment is outlined. Here, a plurality of (e.g., 128) different kinds of tone colors belong to each of a plurality of banks. As stated above, the tone color number identifying a tone color is in the form of three-byte data: "bank select MSB"; "bank select LSB" and "program change number". Namely, one particular bank is specified by a combination of the "bank select MSB" and "bank select LSB" and the particular tone color within the specified bank is specified by the "program change number". Note that the "bank" referred to herein is a virtual bank. In tone color selecting table unit A employed in the instant embodiment, two banks specified by a value "16" of the bank select MSB and values "000" and "001" of the bank select LSB are used as a dedicated area for "loadable tone colors". Namely, the bank specified by the bank select MSB "016" and bank select LSB "000" and "001" is used as a bank dedicated for allocation thereto of a tone to be newly added, i.e. "loadable tone color".

As illustrated in FIG. 6A, tone color selecting table unit A includes "bank select MSB table" "bank select LSB table 1", "bank select LSB table 2" and a plurality of "program change tables". The bank select MSB table is a table associating data values of the bank select MSB table with "bank select LSB table 1" and "bank select LSB table 2" or with values of the program change tables (see FIG. 6B). In the illustrated example, the data values of the bank select MSB are associated such that "bank select LSB table 1" is selected in accordance with the value "000" of the bank select MSB, "bank select LSB table 2" is selected in accordance with the value "016" of the bank select MSB, "program change table 129" (PGM_129) in accordance with the value "064" of the bank select MSB, "program change table 130" (PGM_130) in accordance with the value "126" of the bank select MSB and "program change table 131" (PGM_131) in accordance with the value "127" of the bank select MSB. "bank select table 1" and "bank select table 2" are each a table associating data values of the bank select LSB with the program change tables (see FIGS. 6C and 6D). In the illustrated example, "bank select LSB table 1" is a table for selecting a bank of a "standard tone color" and predetermined program change tables are allocated to all possible values "0" to "127" of bank select LSB table 1. "bank select LSB table 2" is a table for selecting a bank of a "loadable tone color", and values of "bank select LSB table 2" are associated with the program change tables such that "program change table X1" (PGM_X1) is selected in accordance with the value "000" of the bank select LSB and "program change table X2" (PGM X2) is selected in accordance with the value "001" of the bank select LSB. Here, in the bank select MSB table, there are stored only values of the bank select MSB specifying the corresponding bank select LSB tables and program change tables. In each of the bank select LSB tables, there are stored only values of the bank select LSB specifying the corresponding program change tables.

In each of the program change tables, there are stored preset data pointers pointing to respective stored locations of the preset data in the preset data storage area in the ROM 3 or RAM 4 in association with the program change numbers "000" to "127" as seen in FIGS. 6E and 6F. Those of the program change tables (which specifiy the preset data of the prestored tone colors, namely, "standard tone colors") are stored in the ROM 3, and the other program change tables (which specify added tone colors, namely, preset data of "loadable tone colors" are stored in the RAM 4. In accordance with a given program change number, the preset data pointer is read out which points to the preset data of the tone color in question stored in the preset data storage area. Namely, the preset data pointer indicates a leading or first stored location of the preset data of the tone color as illustrated in FIG. 3. Note that tone colors are not allocated to all of the 128 program change numbers "000" to "127". For each of the program change numbers to which no tone color is allocated, identification data (e.g., &HFF (hexadecimal notation)=255), indicating that no tone color is allocated, is stored as a preset data pointer of the program change table.

Next, a detailed description will be made about an exemplary manner in which tone color selecting table unit A is created in the instant embodiment. As stated above, the instant embodiment is described here in relation to the case where the bank specified by the value "016" of the bank select MSB and value "000" or "001" of the bank select LSB is used for storing an added tone color (i.e., "loadable tone color").

If the value of the bank select MSB is "016" the value of the bank select LSB is "000" and the program change number is "000" in the original tone color selection information of a given tone color (preset data) included in a tone color file to be loaded into the tone generator as a "loadable tone color", the pointer corresponding to the program change number "000" in "program change table X1" is rewritten at the time of creating tone color selecting table unit A in the tone color loading process (see step S5 of FIG. 4). Namely, in loading a tone color for which the value of the bank select MSB is "016" the value of the bank select LSB is "000" and the program change number is "000", "bank select LSB table 2" is selected because the bank select MSB is "016". Further, "program change table X1" is selected because the value of the bank select LSB is "000". Furthermore, because the program change number is "000", the pointer pointing to the location in the memory where the preset data of the added tone color are stored is written to the corresponding location of the program change table X1 (see FIG. 6F). On the other hand, if the value of the bank select MSB is other than "016" (e.g., "024"), the value of the bank select LSB is "001" and the program change number is "111" in the original tone color selection information of another tone color (preset data) included in the tone color file to be loaded into the tone generator as a "loadable tone color", the pointer pointing to the location in the memory where the preset data of the tone color are stored is written to the location, corresponding to the program change number "111", of "program change table X2". Namely, even where the tone color file transmitted as a "loadable tone color" file from a source external to the electronic musical instrument corresponds to an existing "standard tone color" for which the value of the bank select MSB is "024", it can be loaded as a "loadable tone color", in which case are selected "bank select LSB table 2" corresponding to the bank select MSB value "016" and "program change table X2" corresponding to the bank select LSB value "001". Note that the selection here of the program change table where the pointer is to be written is just illustrative, and sequentially loaded tone colors may be written into vacant locations (indicated by the preset data pointer "255" as noted earlier) of "program change table X1" or "program change table X2" without regard to the bank select values. Further, in case another tone color than the above-mentioned given tone color is already allocated to the program change number "000" of "program change table X1", the other tone color may be moved and allocated to another vacant program change number, or the given tone color may be allocated to any other vacant program change number.

Namely, in creating tone color selecting table unit A, not only when the value of the bank select MSB of the received "loadable tone color" is "016" but also when the value of the bank select MSB of the received "loadable tone color" is other than "016", "bank select LSB table 2" is selected, and the pointer pointing to the location of the memory where the tone color in question is stored is written into the location corresponding to the program change number of "program change table X1" or "program change table X2".

Figure 7:
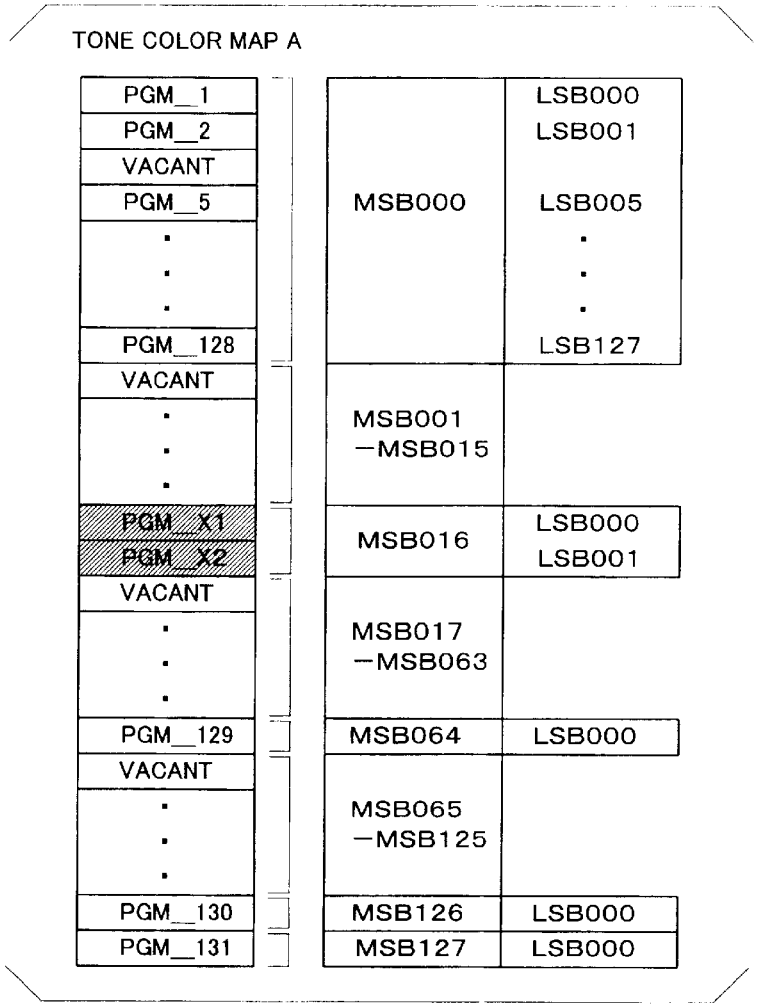
FIG. 7 is a conceptual diagram showing a specific example of tone color map A based on tone color selecting table unit A.

FIG. 7 shows a specific example of tone color map A corresponding to tone color selecting table unit A. Namely, FIG. 7 is a conceptual diagram showing tone color map A (i.e., virtual bank map) based on tone color selecting table unit A described above. In FIG. 7, a tone color map based on the tone color selecting tables prestored in the ROM 3 is denoted by non-hatched blocks, while a tone color map based on the tone color selecting tables newly additionally created in the RAM 4 is denoted by hatched blocks. Program change tables corresponding to the individual banks are shown on the left side of the figure, and values of the bank select MSB and bank select LSB designating the banks are shown on the right side of the figure.

Tone color map A shown in FIG. 7 is obtainable by developing the virtual locations of the individual banks in tone color selecting table unit A shown in FIG. 6A. To select a desired tone color, the user can select a bank, i.e. a program change table, by a combination of values of the bank select MSB and LSB in accordance with tone color map A. For example, designating a bank select MSB value "000" and bank select LSB value "000" can select "program change table 1" (PGM_1), and designating a bank select MSB value "064" and bank select LSB value "000" can "select program change table 129" (PGM_129). Because, as already described above, the program change table is arranged to read out, in accordance with a given program change number, the pointer pointing to the location of the memory where the tone color data are stored, the user can select a desired tone color by designating a program change number along with values of the bank select MSB and bank select LSB. For example, when "000" is designated as the value of the bank select MSB, "001" designated as the value of the bank select LSB and "002" designated as the program change number, a tone color is selected which is stored in the storage location of the memory specified by the pointer INST_T2 (2) of "program change table 2" (PGM 2). Namely, one of "bank select LSB table 1" and "bank select LSB table 2" is selected in accordance with the designated value of the bank select MSB. Then, with reference to the selected "bank select LSB table 1" or "bank select LSB table 2", one of the program change tables is selected in accordance with the designated program change number. After that, with reference to the selected program change table, a tone color is selected in accordance with the designated bank select LSB value. Because, in the illustrated example of tone color selecting table unit A, a user tone color (i.e., "loadable tone color") can be added only to the predetermined bank specified by the value "016" of the bank select MSB and values "000" and "001" of the bank select LSB, the user can select a desired user tone color (i.e., "loadable tone color") by designating the value "016" of the bank select MSB and the value "000" or "001" of the bank select LSB.

Namely, with tone color selecting table unit A (i.e., tone color map A), designating values of the bank select MSB and bank select LSB and a program change number can select a single tone color from among all the tone colors, including the user tone colors (i.e., "loadable tone colors"), stored in the ROM 3 or RAM 4.

Because each of the values "064", "126" and "127" of the bank select MSB in the illustrated example can specify a bank by itself, it can directly specify a program change table without having to further designate a value of the bank select LSB (see FIG. 6B). For example, the value "064" of the bank select MSB represents a bank for a tone color of an effect tone, and the values "126" and "127" of the bank select MSB each represent a bank for a tone color of a percussion instrument tone. Further, in the illustrated example, there are no program change tables corresponding to values "001" to "015", "017" to "063" and "065" to "125" of the bank select MSB; that is, the locations corresponding to these values of the bank select MSB are vacant locations, so that no tone color can be selected even when the user designates any one of these values. In the area of the value "000" of the bank select MSB too, there are values ("002" to "004" and the like) of the bank select LSB for which there are no corresponding program change tables. Thus, if any one of these bank select LSB values is designated, a substitute tone color is selected as appropriate in the instant embodiment; for example, a program change table located close to the designated location in tone color map A may be selected as the substitute tone color. Namely, in the illustrated example, "program change table 2" (PGM_2) or "program change table 5" (PGM_5) may be selected. Alternatively, "program change table 0" (PGM_1) of "bank 0" may be selected as the substitute tone color.

This and following paragraphs detail tone color selecting table unit B. FIGS. 8A to 8D are conceptual diagrams explanatory of the contents of tone color selecting table unit B. Specifically, FIG. 8A is a conceptual diagram explanatory of a general organization of tone color selecting table unit B created in the above-described tone color loading process (see step S6 of FIG. 4). FIGS. 8B to 8D are conceptual diagrams explanatory of individual table contents in tone color selecting table unit B. Note that FIG. 8A show virtual tone color selecting table unit B that comprises combinations of tone color selecting tables prestored in the ROM 3 (denoted by non-hatched blocks) and tone color selecting tables newly added to the RAM 4 (denoted by hatched blocks).

As illustrated in FIG. 8A, tone color selecting table unit B includes a "bank select MSB table", "bank select LSB table 1" and a plurality of program change tables stored in the ROM 3, and "bank select MSB table Y1", "bank select LSB tables Y1, Y2, Y3, . . . " and a plurality of program change tables stored in the RAM 4. Here, the bank select MSB table, "bank select LSB table 1" and program change tables stored in the ROM 3 are exactly the same as the counterparts shown in and described above in relation to FIGS. 6A to 6F; that is, these tables can be shared between tone color selecting table units A and B. When a new tone color table is created and stored in the RAM 4 and if there is a corresponding tone color table in the ROM 3, the tone color table in the ROM 3 is copied and used as initialized data of the tone color table to be newly created. For example, when tone color selecting table unit B is to be created in the tone color loading process (step S6 of FIG. 4), and if the three-byte tone color number, i.e. original tone color information, of a given tone color stored in the PRESET DATA chunk of a "loadable tone color" file, to be loaded into the tone generator, consists of a bank select MSB value "024", bank select LSB value "000" and program change number "000", the bank select MSB table stored in the ROM 3 is copied to the RAM 4 to thereby create "bank select MSB table Y1". Because the ROM 3 contains no bank select LSB table corresponding to the bank select MSB value "024", "bank select LSB table Y1" is then created using, as initial data, the bank select LSB table having no element. Further, "program change table Y1" corresponding to the bank select MSB value "024" and bank select LSB value "000" is created using, as initial data, program change tables where no tone colors are allocated for all the program change numbers "100" to "127". After that, the pointer corresponding to the program change number "000" of "program change table Y1" is rewritten to point to a predetermined location of the RAM 4 storing the preset data of the PRESET DATA chunk of the "loadable tone color" file to be newly added (see FIG. 8D). Further, the program change table corresponding to the bank select LSB value "000" of "bank select LSB table Y1" is rewritten into "program change table Y1" (see FIG. 8C). Furthermore, the bank select LSB table corresponding to the bank select MSB value "024" of "bank select MSB table Y1" is rewritten into "bank select LSB table Y1" (see FIG. 8B).

Namely, in the case where there exist a program change table, bank select LSB table and bank select MSB table that pertain to a "loadable tone color" to be newly added, these existing tables are copied, as initial data, from the ROM 3 to the RAM 4 and then rewritten in accordance with the original tone color selection information of the "loadable tone color", so that the rewritten tables are used for selection of a tone color. Thus, irrespective of where the tone color data (preset data and waveform data) of the "loadable tone color" are loaded, the instant embodiment allows selection or designation of the tone color in accordance with the original tone color selection information thereof. Note that "bank select MSB table Y1" is created only when any one of "loadable tone colors" in a tone color file is loaded for the first time (when there is no bank select MSB table yet). Thus, when a second tone color or tone color following the second one in the tone color file is to be loaded, only a part of already-created "bank select MSB table Y1" may be rewritten in accordance with the original tone color selection information of the tone color to be loaded. Further, in the case where the bank select LSB table corresponding to the bank select MSB of the original tone color selection information of the tone color to be loaded is already present in the RAM 4, it just suffices to rewrite the bank select LSB table on the basis of the original tone color selection information. Further, where the program change table corresponding to the bank select MSB and bank select LSB of the original tone color selection information of the tone color to be loaded is already present in the RAM 4, it just suffices to rewrite the program change table on the basis of the original tone color selection information.

FIG. 9 shows a specific example of tone color map B corresponding to tone color selecting table unit B created by sequentially loading a plurality of tone colors of a loadable tone color file. Namely, FIG. 9 is a conceptual diagram showing tone color map B based on tone color selecting table unit B having been described above. In FIG. 9, a tone color map based on the tone color selecting tables prestored in the ROM 3 is denoted by non-hatched blocks, while a tone color map based on the tone color selecting tables newly additionally created in the RAM 4 is denoted by hatched blocks. Bank select MSB and bank select LSB to be designated to select the tone color map are shown on the right side of the figure, while program change tables corresponding to the bank select MSB and bank select LSB are shown on the left side of the figure.

Tone color map B shown in FIG. 9 is obtainable by developing, as a memory map, the example of tone color selecting table unit B shown in FIG. 8A; however, note that tone color map B of FIG. 9 does not exactly correspond to tone color selecting table unit B of FIG. 8A. To select a tone color, the user can select a program change table by a combination of the bank select MSB and LSB in accordance with tone color map B. For example, designating a bank select MSB value "000" and bank select LSB value "001" can select "program change table Y1" (PGM Y1), and designating a bank select MSB value "016" and bank select LSB value "000" can select "program change table Y2" (PGM_Y2). Because, as already described above, the program change table is arranged to determine, in accordance with a program change number, a pointer pointing to a location of the memory where the tone color is stored, the user can select only a single tone color by designating a program change number along with values of the bank select MSB and bank select LSB.

Namely, with such tone color selecting table unit B, a loadable tone color to be loaded can be allocated (mapped) to a desired addressable location in accordance with the original tone color selection information of the loadable tone color, without being bound by the tone color selecting format compliant with the predetermined tone color standard specific to the electronic musical instrument. In this way, a tone performance can be executed with ease, using the electronic musical instrument employing the tone color selecting format compliant with the predetermined tone color standard, by allocating the tone colors in accordance with the original tone color selecting information of loadable tone colors.

Now, a description will be made about processing for selecting a tone color using tone color selecting table unit A and tone color selecting table unit B.

First, a BS (abbreviation for a bank select MSB and bank select LSB)/PC (abbreviation for a program change number) event process is described with reference to FIG. 10. FIG. 10 is a flow chart showing an example of the BS/PC event process. This BS/PC event process is executed by the CPU 1 of the electronic musical instrument when bank select (BS) and program change (PC) events have occurred in response to user's tone color selecting operation on the panel operator unit 9 or tone color selection information read out from among automatic performance data, namely, when any tone color selecting instruction or tone color selection information has been given. Note that even when only a program change (PC) event has occurred, a similar BS/PC event process is executed by the CPU 1 on the basis of a combination of the program change (PC) event and currently-effective previous bank select (BS) event.

At step S11 of FIG. 10, the CPU 1 obtains respective values of bank select MSB and LSB (BS) and program change number (PC) included in tone color selection information specifying a tone color to be selected, and identifies a part number i specifying a performance part of the tone color to be selected. At next step S12, the CPU 1, using a tone color map (i.e., either one of tone color selecting table unit A and tone color selecting table unit B) corresponding to a mode selection signal MODE indicative of a tone color selection mode, obtains the preset data pointer, pointing to the tone color data (preset data of the selected tone color INSTj) stored in the ROM 3 or RAM 4, in accordance with the bank select MSB and LSB (BS) and program change number (PC) obtained at step S11 above. Then, the thus-obtained preset data pointer is stored in a predetermined register IP(i) corresponding to the part number i. Once tone generation has been instructed for the part number i, the CPU 1 assigns the tone generation instruction to any one of the tone generation channels in the tone generator, and instructs the assigned tone generation channel to generate a tone signal based on the preset data indicated by the register IP(i). Namely, in the part of the part number i, there is generated a tone signal with the tone color corresponding to preset data indicated by the register IP(i). The above-mentioned mode selection signal MODE indicates which of tone color selecting table unit A and tone color selecting table unit B should be used for tone selection. In the instant embodiment, when the mode selection signal MODE is of a value "0", a tone color is determined using tone color map A based on tone color selecting table unit A, but when the mode selection signal MODE is of a value "1", a tone color is determined using tone color map B based on tone color selecting table unit B.

Figure 11:
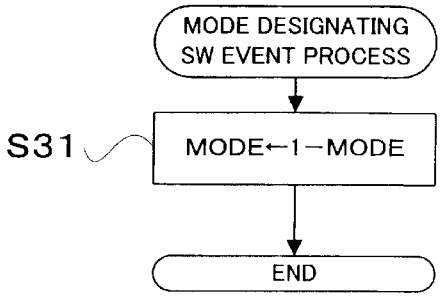
FIG. 11 is a flow chart showing an example of a mode designating switch event process carried out in the embodiment.

Setting of the mode selection signal MODE may be made as desired by the user manipulating a predetermined mode designating switch. Alternatively, the tone color selection mode selection by the signal MODE may be made automatically in accordance with tone color standard ID information included in automatic performance data of a music piece to be performed. FIG. 11 shows a mode designating switch event process carried out each time the mode designating switch is operated. Namely, each time the mode designating switch is operated, a tone-color selection mode inverting arithmetic operation is carried out at step S31 in accordance with a mathematical expression of "1-(currently-set mode)", so that the signal value "1" is inverted to the signal value "0" or the signal value "0" is inverted to the signal value "1"; in this way, the mode selection signal MODE can be shifted between the two values "1" and "0". The value having been obtained through the arithmetic operation is set as a new setting value of the mode selection signal MODE.

The following paragraph describe a note-on event process with reference to FIG. 12. FIG. 12 is a flow chart showing an exemplary step sequence of the note-on event process.

At step S21, the CPU 1 obtains respective values of a note number NN, velocity VEL and part number i given in response to occurrence of a note-on event. At step S22, preparations are made for generation of a tone signal corresponding to the note number NN and velocity VEL, using the tone color data pointed to by the pointer having been obtained by the above-described BS/PC event process and retained in the register IP (i) (see step S12 of FIG. 10). The preparations include assigning a tone generation channel to which a tone waveform is to be transferred for generation of the tone. As shown in FIG. 3, each tone color is composed of a plurality of regions, and the regions are classified according to the note number and/or velocity value. Thus, one tone color INSTj is determined on the basis of the current stored contents of the register IP(i), and further, one of the regions of the determined tone color is determined in accordance with the obtained note number NN and velocity VEL. Then, for the thus-determined tone color INSTj, the parameters in the preset data of the higher hierarchical level, selection information of the waveform data corresponding to the determined region and parameters of the determined region are set, along with the note number NN and velocity VEL, in the assigned tone generation channel of the tone generator 13. At following step S23, the CPU 1 instructs the assigned tone generation channel of the tone generator 13 to generate the tone. Namely, the tone generator 13 reads out the waveform data of that region from the waveform ROM 15 or waveform RAM 16, and generates a tone signal on the basis of the read-out waveform data and set note number, velocity and parameters. In this way, there is sounded the tone having the selected tone color INSTj and corresponding to the designated tone pitch (note number) and performance intensity (velocity).

The following paragraphs describe an automatic mode selection process carried out in response to music piece data, with reference to FIG. 13. FIG. 13 is a flow chart showing an example of a music-piece-data reproduction instruction event process.

At step S41, a music piece data set to be reproduced is designated, for example, by the user using the panel operator unit 9 to select a desired one of music piece names displayed on the panel display 10. In an alternative, a music piece data set may be designated by loading, via a communication line and/or the like, a performance data set of a music piece to be reproduced. At step S42, the performance data format used in the music piece data is examined to determine the tone color selection mode, and the signal MODE is set to the value corresponding to the thus-determined tone color selection mode. For example, the tone color selection mode is determined here by referring to information pertaining to a performance environment (such as tone color standard ID information, information indicative of whether or not to use a loadable tone color, and tone color file name of the loadable tone color if used) included in header data of the music piece. Alternatively, by referring to tone color reset information of any of various tone color standards, such as "GM on" or "XG on", stored at the beginning of the music piece data set, the tone color standard forming the basis to perform the music piece may be determined so that a tone color selection mode is automatically selected in accordance with the thus-determined tone color standard. For example, when neither "GM on" nor "XG on" is included at the beginning of the music piece data set or when only "GM on" is included at the beginning of the music piece data set, the tone color selection mode signal MODE may be set to the value "1". Further, when "XG on" is included at the beginning of the music piece data set, the tone color selection mode signal MODE may be set to the value "0". In an alternative, the value of the tone color selection mode signal MODE (i.e., the data indicating whether priority should be given to the allocation of tone colors based on the tone color standard of the electronic musical instrument or the allocation of loadable tone colors) may be stored in part of the information pertaining to the tone color standard in the header data of the music piece data, and the tone color selection mode signal MODE may be set in accordance with the stored tone color selection value. At step S43, preparations are made for reproducing the music piece data. Then, at step S44, an instruction is given for initiating the reproduction of the music piece data. After that, the BS/PC event process having been described above in relation to FIG. 10, note-on event process having been described above in relation to FIG. 12 and the like are carried out in response to occurrence of various events during the reproductive performance. Tone color selecting table unit A or tone color selecting table unit B is used in accordance with the value of the above-mentioned tone color selection mode signal MODE. Thus, if the music piece data set includes performance data indicating that the loadable tone colors should be given priority, tone color selecting table unit B is selected so that a tone performance can be carried out with optimal tone colors. Similarly, if the music piece data set includes performance data indicating that the MIDI-XG standard should be given priority, tone color selecting table unit A is selected so that a tone performance can be carried out with optimal tone colors.

Whereas the embodiment has been described above as creating tone color map B as well as tone color map A and determining, in accordance with the tone color selection mode signal MODE, either one of the tone color maps that is to be referred to for selection of a tone, replacing tables may be created instead of tone color map B. Thus, the following paragraphs describe another embodiment where a tone color is selected using such a replacing table and tone color selecting table unit A.

First, the replacing tables are described briefly. FIG. 14 is a conceptual diagram showing an example of the replacing tables. The replacing tables are provided in corresponding relation to the bank specified by the bank select MSB value "016" and bank select LSB value "000" and the bank specified by the bank select MSB value "016" and bank select LSB value "001" which together constitute a dedicated area set for allocation thereto of loadable tone colors in accordance with tone color selecting table unit A. One of the replacing tables corresponding to the bank specified by the bank select MSB value "016" and bank select LSB value "000" is represented by reference character Cl, while the other replacing table corresponding to the bank specified by the bank select MSB value "016" and bank select LSB value "001" is represented by reference character C2. In one of the replacing tables (e.g., C1), there are contained 128 replacing data BS & PC(0) to BS & PC(127). In the replacing tables C1 and C2 corresponding to the banks, the original tone color selection information of loadable tone colors allocated to respective addressable locations in accordance with tone color selecting table unit A are stored as the replacing data BS & PC(0) to BS & PC(127). Namely, each of the replacing data BS & PC(0) to BS & PC(127) comprises a set of the bank select MSB and LSB (BS) and program change number (PC) indicative of the original tone color selection information to be replaced. These replacing tables C1 and C2 are created simultaneously when tone color selecting table unit A is created, to add the tone color data of loadable tone colors. Because the replacing tables C1 and C2 each have stored therein, as the replacing data, the original tone color selection information of the loadable tone colors so that the original tone color selection information can be acquired in accordance with the allocation indicated by tone color selecting table unit A, the replacing tables C1 and C2 permit selection of desired tone color data in accordance with the original tone color selection information even where the loadable tone colors are allocated to the dedicated areas in accordance with tone color selecting table unit A.

Let it be assumed here that when a tone color file of a loadable tone color imparted with original tone color selection information indicative of the bank select MSB value "024", bank select LSB value "005" and program change number "010" has been loaded, the tone color file is allocated, in accordance with tone color selecting table A, to an addressable location specified by the bank select MSB value "016" bank select LSB value "001" and program change number "010". In such a case, the original tone color selection information indicative of the bank select MSB value "024" bank select LSB value "005" and program change number "010" is stored in the replacing table C2 as replacing data BS & PC(10) corresponding to the program change number "010" (of the bank select LSB "001"). Needless to say, no replacing table is created in cases where no replacement of the original tone color selection information is required. For example, when a tone color file of a loadable tone color imparted with original tone color selection information indicative of the bank select MSB value "016", bank select LSB value "001" and program change number "010" has been loaded and allocated to the same addressable location as indicated by the original tone color selection information, there is, of course, no need to store corresponding replacing data in the replacing table; however, even in such a case, the corresponding replacing data may be stored to reduce conditional branches and simplify the necessary control.

The replacing tables C1 and C2 may be created in the above-described manner, in place of tone color selecting table unit B, at step S6 of the tone color loading process of FIG. 4. Creating the replacing tables achieves the benefit that it can reduce the necessary storage capacity as compared to the case where tone color selecting table unit B is created. Note that the mode of using the replacing tables as described here corresponds to the mode of using tone color selecting table unit B (MODE=1) in the first-described embodiment.

Figure 15:
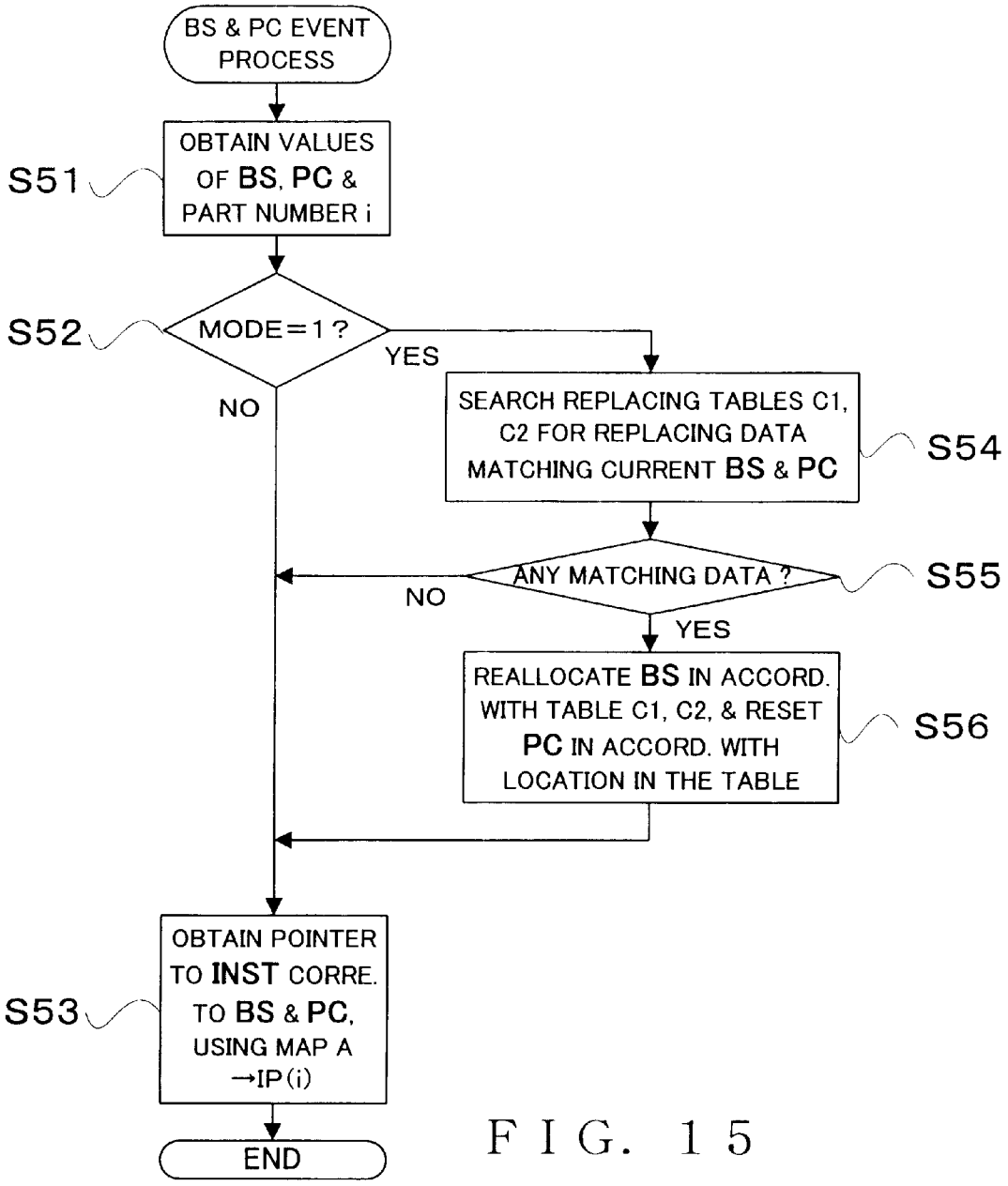
FIG. 15 is a flow chart showing an exemplary step sequence of the BS & PC event process performed in a case where the replacing tables are used in the embodiment.

FIG. 15 flow charts an exemplary step sequence of the BS & PC event process performed in the case where the replacing tables are used.

At step S51, similarly to step S11 of FIG. 10, the CPU 1 obtains respective values of the bank select MSB and LSB (BS) and program change number (PC) from the tone color selection information of a tone color to be selected, and identifies and enters a part number i of the tone. At step S52, a determination is made as to whether the setting of the tone color selection mode signal MODE is "1" or not. If the setting of the tone color selection mode signal MODE is not "1" (i.e., MODE="0") as determined at step S52, the CPU 1 uses tone color map A based on tone color selecting table A to obtain the preset data pointer to the ROM 3 or RAM 4, having stored therein the tone color data (preset data), in accordance with the bank select MSB and LSB (BS) and program change number (PC). The thus-obtained preset data pointer is set in the register IP(i). Namely, in this case, the tone color map compliant with the predetermined tone color standard is given priority by using tone color selecting table A.

If, on the other hand, the setting of the tone color selection mode signal MODE is "1" (YES determination at step S52), a search is made, at step S54, through the replacing tables C1 and C2 for replacing data that matches or corresponds with the currently-obtained bank select MSB and bank select LSB (BS) and program change number (PC). If the search result shows that there is no such corresponding replacing data in the replacing tables C1 and C2 (NO determination at step S55), the CPU 1 branches to step S53. Namely, in this case, no replacement takes place, and the tone color selection is made in accordance with tone color selecting table unit A. If, on the other hand, the search result of step S54 shows that there is the corresponding replacing data in the replacing tables C1 and C2 (YES determination at step S55), the bank select LSB is reset depending on which of the replacing tables C1 and C2 the corresponding replacing data is stored in. Namely, if the corresponding replacing data is stored in the replacing table C1, the bank select LSB is reset to "000", while if the corresponding replacing data is stored in the other replacing table C2, the bank select LSB is reset to "001". In either case, the bank select MSB is reset to "016" (dedicated area for loadable tone colors). Then, at step S56, the program change number (PC) is reset in accordance with the addressable location, in the replacing table, of the corresponding replacing data. For example, if the 15th replacing data in the replacing table C1 has matched the currently-obtained bank select MSB and bank select LSB (BS) and program change number (PC), the bank select MSB is reset to "016", the bank select LSB is reset to "000", and the program change number is reset to "014". In this manner, tone color replacement (conversion of the bank select BS and program change PC) is carried out in the tone color map. In this case, the tone color selecting information entered at step S51 is the original tone color selecting information of a loadable tone color, and thus the search is made through the replacing tables C1 and C2 for replacing data that matches or corresponds with the original tone color selecting information.

Let's also assume a case where when a tone color file of a loadable tone color imparted with original tone color selection information indicative of the bank select MSB value "024", bank select LSB value "005" and program change number "010", the tone color file is allocated, in accordance with tone color selecting table A, to an addressable location of the bank select MSB value "016", bank select LSB value "001" and program change number "010" and that the original tone color selection information indicative of the bank select MSB value "024", bank select LSB value "005" and program change number "010" is stored in the replacing table C2 as replacing data BS & PC(10) corresponding to the program change number "010" (of the bank select LSB "001"), as in the above-described example. In this case, when the original tone color selection information indicative of the bank select MSB value "024", bank select LSB value "005" and program change number "010" is entered as information designating a desired tone color to be selected while the tone color selection mode signal MODE is "1" the replacing data BS & PC(10) stored in the replacing table C2 is determined as corresponding with the entered original tone color selection information, so that the tone color selection information is replaced, by the resetting operation at step S56, with information indicative of a dedicated area based on tone color selecting table A that is represented by the bank select MSB value "016", bank select LSB value "001" and program change number "010". In this way, the CPU 1 can obtain the pointer pointing to the stored location of the desired tone color data. Namely, a virtual tone color map (provisionally represented by A') is created by reorganizing tone color map A, so that a desired tone color can be selected using the virtual tone color map A'.

Figure 16:
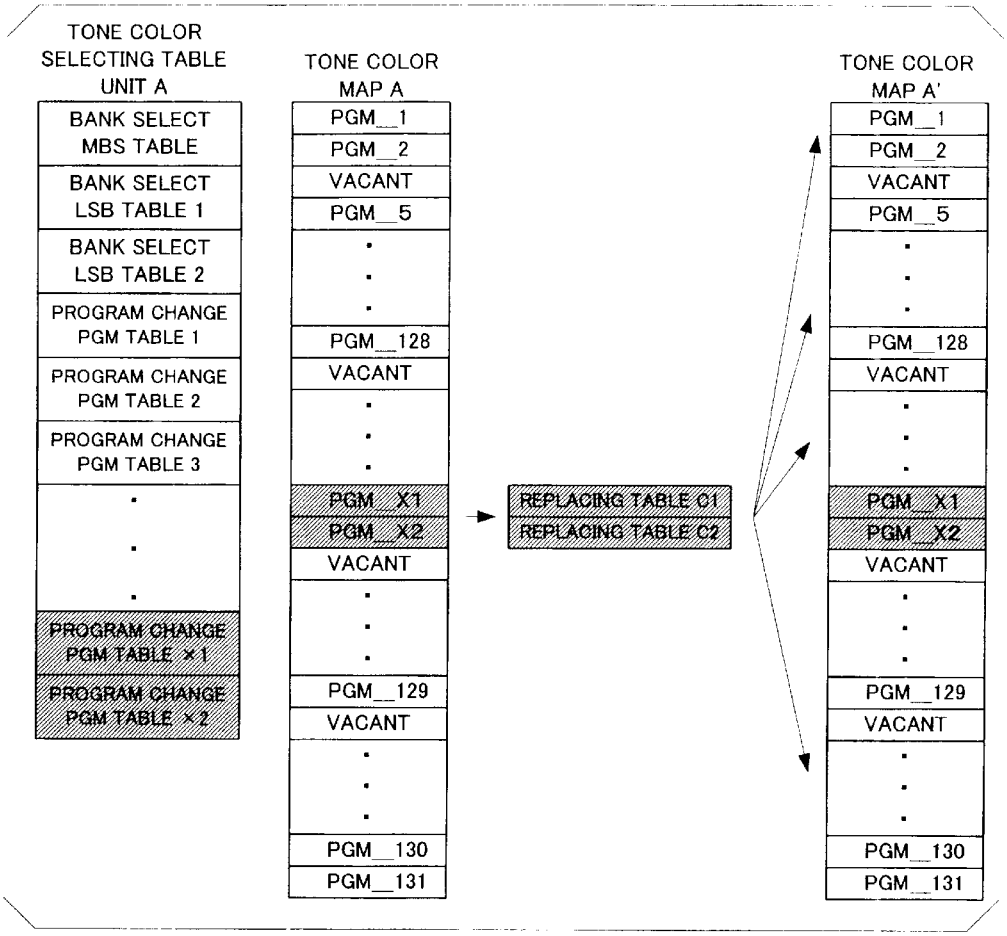
FIG. 16 is a diagram explanatory of tone color selection in the case where the replacing tables are used.

Further, FIG. 16 is explanatory of an example of the tone color selection by the replacement using the above-described replacing tables. As noted above, the replacing tables allow the virtual tone color map A' to be created by reorganizing tone color map A based on tone color selecting table A, and thereby allows a desired tone color to be selected using the virtual tone color map A'. For example, even where the tone color file imparted with the original tone color selection information indicative of the bank select MSB value "024", bank select LSB value "005" and program change number "010" is actually allocated to an addressable location represented by the bank select MSB value "016", bank select LSB value "001" and program change number "009", the tone color in question can be accurately selected when the bank select MSB value "024", bank select LSB value "005" and program change number "010" have been designated in the same manner as the original tone color selection information. That is, even where the tone color file is actually allocated to an addressable location as indicated on tone color map A of FIG. 16, the tone color can be accurately designated from among tone colors of tone color map A by reference to the map A' constructed virtually with the replacing table C1 or C2.

When a loadable tone color is to be allocated to the dedicated area using tone color selecting table A in the instant embodiment, the tone color data may be allocated to a same location in the dedicated area indicated by the original tone color selection information if the original tone color selection information of the loadable tone color indicates the dedicated area; if not, the tone color data may be allocated to any other vacant location within the dedicated area. For example, if the original tone color selection information of the loadable tone color indicates the bank select MSB value "016" and bank select LSB value "000" or "001", the tone color data may be allocated to exactly the same location within the bank as indicated by the program change number included in the tone color selection information; otherwise, the tone color data may be allocated to any other vacant location within the dedicated bank. This arrangement can simplify the organization of the replacing tables. Further, even in the case where only tone color selecting table unit A is used, the arrangement permits selection of a tone color as close to the original tone color selection information as possible.

Further, in the case where tone color selecting table unit B is used to give priority to a loadable tone color over the standard tone color, and if the loadable tone color has been canceled, the above-described embodiment may operate to restore the corresponding standard tone color. Namely, there may be provided a means, such as a switch, for canceling the tone color data of the loadable tone loaded from an external source and allocated to the tone color selecting space so that the user can perform operation for cancelling (i.e., unloading) the loaded tone color as desired. After cancellation of the tone color data loaded from the external source, the location where the tone color data loaded from the external source have been stored so far is reset to the initial location based on the predetermined tone color standard. This arrangement permits tone color management free of inconveniences.

It should be appreciated that whereas the embodiments has been described above using both the bank select MSB and bank select LSB for selection of a tone color, the present invention is not so limited. For example, a tone color may be selected using only the bank select LSB; namely, a program change table may be selected only using the bank select LSB so that a pointer pointing to a location of a tone color can be selected from the program change table in accordance with a program change number.

It should also be appreciated that the above-described tone color loading process, BS & PC event process, note-on event process, mode designating switch event process and music-piece-data reproduction instruction event process may be performed by other means than the software programs, such as a DSP device constructed to operate in accordance with microprograms executing the same processing as in the above-described embodiment. Alternatively, dedicated hardware circuitry may be constructed, using LSI and/or discrete circuits, which executes the same processing as in the above-described embodiment.

In the case where the tone color selection apparatus of the present invention is applied to an electronic musical instrument as described above, the electronic musical instrument may be of any type other than a keyboard type, such as a stringed instrument, wind instrument or percussion instrument type. It should also be appreciated that the electronic musical instrument is not limited to the type where the tone generator device, tone color section apparatus, etc. are incorporated together within the body of the electronic musical instrument, and may be of another type where the tone generator device, tone color section apparatus, etc. are provided separately from each other but can be connected with each other via MIDI interfaces and communication facilities such as a communication network. Further, the electronic musical instrument may comprise a combination of a personal computer and application software, in which case various processing programs may be supplied from a storage medium, such as a magnetic disk, optical disk or semiconductor memory or via a communication network. Further, the tone color selection apparatus may be applied to automatic performance apparatus such as a karaoke apparatus and player piano, electronic game apparatus, portable communication terminals such as cellular mobile phones, etc. In the case where the tone color selection apparatus is applied to a portable communication terminal, the portable communication terminal need not necessarily have all the predetermined functions; part of the functions may be performed by a server so that a system comprising the portable communication terminal and the server performs the predetermined functions.

It should also be appreciated that in the case where the tone color selection apparatus is applied to an automatic performance apparatus, performance data designating tones to be generated may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event. Further, the generated performance data during an automatic performance may be processed by any desired method, such as one where the processing period is varied in accordance with a set tempo or one where the manner of counting timing data in the performance data is varied, per processing, in accordance with a set tempo. Furthermore, where performance data sets for a plurality of channels are handled in the present invention, the performance data sets for the plurality of channels may be stored together in a mixture or the performance data sets for the channels may be separated from each other on a track-by-track basis.

The embodiment has been described above in relation to the case where one of a plurality of the regions is specified in accordance with pitch information and/or velocity value. However, when a tone color made up of a plurality of waveforms overlapping each other is to be implemented, it is only necessary that the present invention be arranged such that a plurality of the regions to overlap each other can be specified.

Furthermore, in the above-described embodiment, the memory for physically storing data of a "loadable tone color" loaded from an external source is the waveform RAM 16, for example, in the form of a hard disk belonging to the electronic musical instrument, personal computer or the like; however, the present invention is not so limited, and such a memory may be a remote memory connected to the tone color selection apparatus of the present invention via a communication line. Namely, the waveform RAM 16 may be provided in any desired location as long as it is manageable via the access management section 14.

In summary, the present invention is characterized in that a dedicated area for allocation thereto of tone color data externally loadable from outside the tone color selection apparatus is set in the tone color selecting space compliant with the predetermined tone color standard, and externally loaded tone color data is allocated to the thus-set dedicated area. Thus, in the present invention, mapping is performed such that the tone color data externally loaded from the outside are allocated to the dedicated area of the tone color selecting space and then selection of the externally loaded tone color data is made in accordance with tone color selection information designating the dedicated area pursuant to a predetermined tone color standard. Thus, the externally loaded tone color data can be selected without disturbing mapping or allocation rules compliant with the predetermined tone color standard. For example, even when an area where a substitute tone color compliant with the predetermined tone color standard should be allocated is vacant or empty in the tone color selecting space compliant with the predetermined tone color standard, the externally tone color data can be prevented from being indiscriminately allocated to that vacant area, so that it is possible to avoid any inconvenience in the tone color selection based on the predetermined tone color standard.

Further, the present invention is characterized in that when the "externally loaded tone color data" are to be allocated (mapped) to the tone color selecting space compliant with the predetermined tone color standard, the externally loaded tone color data are allocated, with priority over other data, to a given addressable location, of the tone color selecting space, according to the original tone color selection information of the externally loaded tone color data. When other tone color data are already allocated to the given addressable location of the tone color selecting space, and even if the other tone color data are compliant with the predetermined tone color standard, the processor makes the other tone color data non-selectable, and allocates (maps) the externally loaded tone color data in accordance with the original tone color selection information. Thus, even when an automatic performance is to be executed, in a tone generation apparatus including a tone color selecting space compliant with a predetermined tone color standard, in accordance with performance data including original tone color selection information of loadable tone color data, the performance can be carried out appropriately taking advantage of the allocation, to an addressable location of the tone color selecting space, of the original tone color selection information.

The present invention relates to the subject matter of Japanese Patent Application No. 2001-094490 filed Mar. 29, 2001, the disclosure of which is expressly incorporated herein by reference in its entirety.

What is claimed is:

1. A tone color selection apparatus including a tone color selecting space where tone color data are allocated to addressable locations thereof in association with tone color selection information in accordance with a predetermined tone color standard, to allow desired tone color data to be selected from said tone color selecting space in response to given tone color selection information, said tone color selection apparatus comprising:

a memory;

a loading device adapted to load tone color data externally loadable from outside said tone color selection apparatus, tone color data externally loaded from outside said tone color selection apparatus via said loading device being stored in said memory; and a processor coupled with said loading device and said memory and adapted to set, in said tone color selecting space compliant with the predetermined tone color standard, a dedicated area for allocation thereto of the externally loaded tone color data, and allocating the externally loaded tone color data, stored in said memory, to the dedicated area in such a manner that the tone color data can be selected in response to tone color selection information designating the dedicated area.

2. A tone color selection apparatus as claimed in claim 1 wherein said memory also stores other tone color data compliant with the predetermined tone color standard, said processor has a tone color selecting table defining correspondency between the tone color selection information and stored locations, in said memory, of the tone color data, and said tone color selecting table is addressable by the tone color selection information, and wherein the dedicated area is set in said tone color selecting table, and information indicative of the stored location, in said memory, of the externally loaded tone color data is stored in the dedicated area of said memory.

3. A tone color selection apparatus as claimed in claim 2 wherein said tone color selecting space is a virtual space for mapping tone color data and includes said tone color selecting table and said memory.

4. A tone color selection apparatus as claimed in claim 1 wherein the tone color data externally loadable from outside said tone color selection apparatus includes original tone color selection information indicative of an original allocated addressable location specific thereto, and wherein said processor is further adapted to replace the original tone color selection information with tone color selection information designating the dedicated area in accordance with the predetermined tone color standard, and said processor is also adapted to select the tone color data from the dedicated area in accordance with the original tone color selection information.

5. A tone color selection apparatus as claimed in claim 1 wherein a plurality of tone color data can be allocated to the dedicated area of said tone color selecting space, and the loadable tone color data include original tone color selection information indicative of an original allocated addressable location specific thereto, and wherein when the externally loaded tone color data are to be allocated to the dedicated area, the externally loaded tone color data are allocated to a particular location, in the dedicated area, specified by the original tone color selection information if the original tone color selection information of the externally loaded tone color data specifies the dedicated area, but, if the original tone color selection information of the externally loaded tone color data does not specify the dedicated area, the externally loaded tone color data are allocated to another available location in the dedicated area.

6. A tone color selection apparatus including a tone color selecting space where tone color data are allocated to addressable locations thereof in association with tone color selection information in accordance with a predetermined tone color standard, to allow desired tone color data to be selected from said tone color selecting space in response to given tone color selection information, said tone color selection apparatus comprising:

a memory;

a loading device adapted to load tone color data externally loadable from outside said tone color selection apparatus, the tone color data externally loadable from outside said tone color selection apparatus via said loading device being stored in said memory, the externally loadable tone color data including original tone color selection information indicative of an original allocated addressable location specific thereto; and a processor coupled with said loading device and said memory, said processor being adapted to allocate the externally loaded tone color data, stored in said memory, to a given addressable location in said tone color selecting space such that the externally loaded tone color data can be selected in response to the original tone color selection information of the externally loaded tone color data, wherein when other tone color data are already allocated to the given addressable location, said processor makes the externally loaded tone color data selectable with priority and makes the other tone color data non-selectable, whereby the externally loaded tone color data can be selected in response to the original tone color selection information.

7. A tone color selection apparatus as claimed in claim 6 wherein said memory also stores other tone color data compliant with the predetermined tone color standard, said processor has a tone color selecting table defining correspondency between the tone color selection information and stored locations, in said memory, of the tone color data, and said tone color selecting table is addressable by the tone color selection information, and wherein information indicative of the stored location, in said memory, of the externally loaded tone color data is stored in an area of said tone color selecting table addressable by the original tone color selection information.

8. A tone color selection apparatus as claimed in claim 6 which further comprises an operator operable to cancel the externally loaded tone color data allocated to a particular addressable location in said tone color selecting space, and wherein when the externally loaded tone color data are canceled by canceling operation via said operator, said processor resets the particular addressable location in said tone color selecting space where the externally loaded tone color data have been stored so far, to an initial addressable location compliant with the predetermined tone color standard.

9. A tone color selection apparatus including a tone color selecting space where tone color data are allocated to addressable locations thereof in association with tone color selection information in accordance with a predetermined tone color standard, to allow desired tone color data to be selected from said tone color selecting space in response to given tone color selection information, said tone color selection apparatus comprising:

a memory;

a loading device adapted to load tone color data externally loadable from outside said tone color selection apparatus, tone color data externally loaded from outside said tone color selection apparatus via said loading device being stored in said memory;

a processor coupled with said loading device and said memory and adapted to:

set, in the tone color selecting space compliant with the predetermined tone color standard, a dedicated area for allocation thereto of tone color data externally loadable from outside said tone color selection apparatus, and allocate the externally loaded tone color data, stored in said memory, to the dedicated area in such a manner that the externally loaded tone color data can be selected in response to tone color selection information designating the dedicated area;

execute a first process for making the externally loaded tone color data selectable in response to the tone color selection information designating the dedicated area; and execute a second process for replacing original tone color selection information specific to the externally loaded tone color data with the tone color selection information designating the dedicated area where the externally loaded tone color data are allocated, and for making the externally loaded tone color data selectable in response to the replaced tone color selection information so that the externally loaded tone color data can be selected with the addressable location specified by the original tone color selection information; and a mode selector coupled with said processor and adapted to select one of a first mode for causing said processor to select the tone color data through said first process and a second mode for causing said processor to select the tone color data through said second process.

10. A tone color selection apparatus as claimed in claim 9 wherein said mode selector makes a determination, in accordance with information indicative of a tone color standard included in performance data, as to whether tone color data compliant with the predetermined tone color standard should be used or the externally loaded tone color data should be used, and automatically selects one of said first mode and said second mode on the basis of a result of the determination.

11. A tone color selection apparatus including a tone color selecting space where tone color data are allocated to addressable locations thereof in association with tone color selection information in accordance with a predetermined tone color standard, to allow desired tone color data to be selected from said tone color selecting space in response to given tone color selection information, said tone color selection apparatus comprising:

a memory;

a loading device adapted to load tone color data externally loadable from outside said tone color selection apparatus, tone color data externally loaded from outside said tone color selection apparatus via said loading device being stored in said memory;

a processor coupled with said loading device and said memory and adapted to:

execute a first process for setting, in said tone color selecting space compliant with the predetermined tone color standard, a dedicated area for allocation thereto of tone color data externally loadable from outside said tone color selection apparatus, allocating the externally loaded tone color data, stored in said memory, to the dedicated area in such a manner that the externally loaded tone color data can be selected in response to tone color selection information designating the dedicated area, and making the externally loaded tone color data selectable in response to the tone color selection information designating the dedicated area; and execute a second process for allocating the externally loaded tone color data, stored in said memory, to a given addressable location in said tone color selecting space such that the externally loaded tone color data can be selected in response to original tone color selection information specific to the externally loaded tone color data, and for, when other tone color data are already allocated to the given addressable location, making the externally loaded tone color data selectable with priority and making the other tone color data non-selectable, to thereby allow the externally loaded tone color data to be selected in response to the original tone color selection information; and a mode selector coupled with said processor and adapted to select one of a first mode for causing said processor to select the tone color data through said first process and a second mode for causing said processor to select the tone color data through said second process.

12. A tone color selection apparatus as claimed in claim 11 wherein said mode selector makes a determination, in accordance with information indicative of a tone color standard included in performance data, as to whether tone color data compliant with the predetermined tone color standard should be used or the externally loaded tone color data should be used, and automatically selects one of said first mode and said second mode on the basis of a result of the determination.

13. A method for selecting tone color data, in response to given tone color selection information, from a tone color selecting space where tone color data are allocated to addressable locations thereof in association with tone color selection information in accordance with a predetermined tone color standard, said method comprising a step of setting, in said tone color selecting space compliant with the predetermined tone color standard, a dedicated area for allocation thereto of tone color data externally loadable from outside, and allocating tone color data externally loaded from outside to the dedicated area in said tone color selecting space, wherein the externally loaded tone color data allocated to the dedicated area in said tone color selecting space can be selected in response to tone color selection information designating the dedicated area in accordance with the predetermined tone color standard.

14. A method as claimed in claim 13 wherein said tone color selecting space includes a memory for accumulating data, and said method further comprises a step of loading the tone color data externally loadable from outside, the tone color data externally loaded by said step of loading being stored in said memory.

15. A method as claimed in claim 13 wherein the tone color data externally loadable from outside includes original tone color selection information indicative of an original allocated addressable location specific thereto, and wherein said method further comprises a step of replacing the original tone color selection information with tone color selection information designating the dedicated area in accordance with the predetermined tone color standard, and the tone color data can be selected from the dedicated area in accordance with the original tone color selection information.

16. A computer program comprising computer program code means for performing all the steps of claim 13 when said program is run on a computer.

17. A method for selecting tone color data, in response to given tone color selection information, from a tone color selecting space where tone color data are allocated to addressable locations thereof in association with tone color selection information in accordance with a predetermined tone color standard, said method comprising:

a step of loading tone color data externally loadable from outside, the tone color data externally loadable from outside including original tone color selection information indicative of an original allocated addressable location specific thereto; and a step of allocating the tone color data, externally loaded from outside by said step of loading, to a given addressable location in said tone color selecting space such that the externally loaded tone color data can be selected in response to the original tone color selection information of the externally loaded tone color data, wherein when other tone color data are already allocated to the given addressable location, the externally loaded tone color data are made selectable with priority and the other tone color data are made non-selectable, whereby the externally loaded tone color data can be selected from said tone color selecting space in response to the original tone color selection information.

18. A computer program comprising computer program code means for performing all the steps of claim 17 when said program is run on a computer.

19. A method for selecting tone color data, in response to given tone color selection information, from a tone color selecting space where tone color data are allocated to addressable locations thereof in association with tone color selection information in accordance with a predetermined tone color standard, said method comprising:

a step of loading tone color data externally loadable from outside;

a step of selecting one of a first mode and second mode for tone selection;

a step of setting, in said tone color selecting space compliant with the predetermined tone color standard, a dedicated area for allocation thereto of the tone color data externally loadable from outside, and allocating the tone color data, externally loaded from outside by said step of loading, to the dedicated area in such a manner that the externally loaded tone color data can be selected in response to tone color selection information designating the dedicated area;

a step of, when said first mode is selected by said step of selecting, making the externally loaded tone color data selectable in response to the tone color selection information designating the dedicated area; and a step of, when said second mode is selected by said step of selecting, replacing original tone color selection information specific to the externally loaded tone color data with the tone color selection information designating the dedicated area where the externally loaded tone color data are allocated, and making the externally loaded tone color data selectable in response to the replaced tone color selection information so that the externally loaded tone color data can be selected with the addressable location specified by the original tone color selection information.

20. A computer program comprising computer program code means for performing all the steps of claim 19 when said program is run on a computer.

21. A method for selecting tone color data, in response to given tone color selection information, from a tone color selecting space where tone color data are allocated to addressable locations thereof in association with tone color selection information in accordance with a predetermined tone color standard, said method comprising:

a step of loading tone color data externally loadable from outside;

a step of executing a first process for setting, in said tone color selecting space compliant with the predetermined tone color standard, a dedicated area for allocation thereto of the tone color data externally loadable from outside, allocating the externally loaded tone color data to the dedicated area in such a manner that the externally loaded tone color data can be selected in response to tone color selection information designating the dedicated area, and making the externally loaded tone color data selectable in response to the tone color selection information designating the dedicated area; and a step of executing a second process for allocating the tone color data externally loaded from outside to a given addressable location in said tone color selecting space such that the tone color data externally loaded from outside can be selected in response to original tone color selection information specific to the tone color data externally loaded from outside, and, when other tone color data are already allocated to the given addressable location, making the externally loaded tone color data selectable with priority and making the other tone color data non-selectable, to thereby allow the externally loaded tone color data to be selected in response to the original tone color selection information; and a step of selecting one of a first mode and second mode for tone selection, wherein when said first mode is selected, tone color selection is made through said first process executed by said step of executing said first process, but, when said second mode is selected, tone color selection is made through said second process executed by said step of executing said second process.

22. A computer program comprising computer program code means for performing all the steps of claim 21 when said program is run on a computer.

* * * * *